US007196261B2

(12) United States Patent
Suenaga

(10) Patent No.: US 7,196,261 B2
(45) Date of Patent: Mar. 27, 2007

(54) ELECTRONIC PERCUSSION INSTRUMENT FOR PRODUCING SOUND AT INTENDED LOUDNESS AND ELECTRONIC PERCUSSION SYSTEM USING THE SAME

(75) Inventor: Yuichiro Suenaga, Shizuoka (JP)

(73) Assignee: Yamaha Corporation, Shizuoka-Ken (JP)

( * ) Notice: Subject to any disclaimer, the term of this patent is extended or adjusted under 35 U.S.C. 154(b) by 191 days.

(21) Appl. No.: 10/400,493

(22) Filed: Mar. 28, 2003

(65) Prior Publication Data

US 2003/0188629 A1 Oct. 9, 2003

(30) Foreign Application Priority Data

Apr. 5, 2002 (JP) ..... 2002-104587

(51) Int. Cl.
*G10H 3/00* (2006.01)

(52) U.S. Cl. ..... 84/730; 310/339; 310/331

(58) Field of Classification Search ..... 84/723, 84/730–732, 734; 310/329, 330, 336, 339, 310/331; 73/651, 654, 862.41
See application file for complete search history.

(56) References Cited

U.S. PATENT DOCUMENTS

| | | | | |
|---|---|---|---|---|
| 3,186,237 | A * | 6/1965 | Forrest | 73/514.34 |
| 4,307,602 | A * | 12/1981 | Sawada et al. | 73/35.11 |
| 4,441,370 | A * | 4/1984 | Sakurada | 73/651 |
| 4,732,070 | A * | 3/1988 | Yamashita | 84/746 |
| 4,984,498 | A * | 1/1991 | Fishman | 84/730 |
| 5,801,475 | A * | 9/1998 | Kimura | 310/319 |
| 5,920,026 | A * | 7/1999 | Yoshino et al. | 84/738 |
| 6,376,967 | B2 * | 4/2002 | Saarmaa et al. | 310/329 |
| 6,784,352 | B2 * | 8/2004 | Suenaga | 84/411 R |

FOREIGN PATENT DOCUMENTS

| | | |
|---|---|---|
| JP | 63-92399 | 6/1988 |
| JP | 63-128597 | 8/1988 |
| JP | 5042356 | 8/1991 |
| JP | 5345037 | 9/1994 |
| JP | 8-44357 | 2/1996 |
| JP | 9-311684 | 12/1997 |
| JP | 10-20854 | 1/1998 |
| JP | 2001-215963 | 8/2001 |

OTHER PUBLICATIONS

Copy of Japanese Office Action dated Feb. 28, 2006 (and English translation of relevant portion).

* cited by examiner

*Primary Examiner*—Lincoln Donovan
*Assistant Examiner*—David S. Warren
(74) *Attorney, Agent, or Firm*—Dickstein Shapiro LLP

(57) ABSTRACT

An electronic drum includes a pad to be beaten with sticks, a circular piezoelectric converter for converting stress to an electric signal and a semi-circular filter element adhered at one surface to the pad and at the other surface to the circular piezoelectric converter; the circular piezoelectric converter is partially held in contact with the semi-circular filter element and partially overhung under the pad; when the vibrations reach the filter element, the filter element eliminates high frequency vibration components from the vibrations, and transmits them to the half of the circular piezoelectric converter; the vibrations give rise to bending stress in the half of the piezoelectric converter held in contact with the filter element, and shake the other half of the piezoelectric converter; this results in enlargement of the bending stress, and the electric signal with a wide amplitude is taken out from the piezoelectric converter.

23 Claims, 13 Drawing Sheets

ELECTRONIC PERCUSSION INSTRUMENT FOR PRODUCING SOUND AT INTENDED LOUDNESS AND ELECTRONIC PERCUSSION SYSTEM USING THE SAME

FIELD OF THE INVENTION

This invention relates to a percussion instrument and, more particularly, to an electronic percussion instrument equipped with a sensor for converting vibrations to an electric signal and an electronic percussion system.

DESCRIPTION OF THE RELATED ART

Although the percussion includes a wide variety of family members, they have the resonating surfaces struck by a player. The vibrations are radiated as the drum sound, or are magnified through resonators for the drum sound. These family members are "acoustic percussion instruments. The other family members convert the vibrations to an electric signal. The electric signal is processed so as to give the timing to generate the drum sound to a tone generator, and the tone generator electronically produces a digital audio signal. The digital audio signal is converted to an analog audio signal, and the drum sound is produced from the audio signal. Those family members are hereinbelow referred to as "electronic percussion instruments".

FIGS. 1 and 2 show an example of the drum pad 100 forming a part of the first prior art electronic percussion instrument. The prior art drum pad 100 largely comprises a pad 111*a* and an impact sensor 111*b*. The impact sensor 111*b* is adhered to a central area of the reverse surface of the pad 111*a*, and converts vibrations of the pad 111 to an electric signal representative of the waveform of the vibrations.

The pad 111*a* includes a rigid plate 112 and a rubber layer 113. The rigid plate 112 is made of iron, and has a disc-shape. The rubber layer 113 also has a disc-shape, and the rigid plate 112 is overlaid with the rubber layer 113. The rubber layer 113 is adhered to the rigid plate 112. The rubber layer 113 has a major surface 100*a*, and a player beats the major surface 100*a* with sticks. The impacts on the major surface give rise to the vibrations of the rigid plate 112, and the vibrations are propagated to the central area. The converter 111*b* converts the vibrations to the electric signal.

On the other hand, the impact sensor 111*b* includes a piezoelectric converter 114 and a signal output cable 114*a*. The piezoelectric converter 114 has a disc shape, and converts the mechanical stress exerted thereon to electric charge. The electric charge flows out from the piezoelectric converter 114 as the electric signal. The piezoelectric element 114 is adhered to the central area of the reverse surface of the rigid plate 112 by means of a sheet of adhesive double coated tape 115. The sheet of adhesive double coated tape 115 is circular configuration, and is nearly equal in diameter to the piezoelectric converter 114. The sheet of adhesive double coated tape has adhesive compound layers on both side of a sponge sheet so that high frequency vibration components are eliminated from the vibrations. The signal output cable 114*a* is fixed to the piezoelectric converter 114, and the electric charge flows into the signal output cable 114*a*. The electric charge or electric signal is propagated to a tone generator (not shown).

It is an important feature of the electronic percussion instruments to produce the drum sound at certain loudness regardless of spots on the drum pad beaten with the sticks in so far as the impacts are equal in magnitude to one another. An electronic percussion instrument is assumed to generate the drum sound at certain loudness when a player beats a central area of the drum pad of the electronic percussion instrument. The player expects the electronic percussion instrument to generate the drum sound at the same loudness even if he or she beats a peripheral area of the drum pad with the sticks at the same magnitude. This phenomenon, viz., the vibration propagating characteristics dependent on the beaten spots are hereinbelow referred to as "local dependency".

The first prior art drum pad 100 exhibit serious local dependency. This is because of the fact that the sheet of adhesive double coated tape is much smaller in area than the pad 111*a*. When a player beats the central area on the major surface 100*a*, the impacts immediately reach the piezoelectric converter 114 through the sheet of adhesive double coated tape 115, and give rise to a large amount of electric charge in the piezoelectric converter 114. However, when the player beats the peripheral area on the major surface 100*a*, the impacts are propagated through the rigid plate 112, and reach the piezoelectric converter 114 through the sheet of adhesive double coated tape 115. While the rigid plate 112 is propagating the beats to the piezoelectric converter 114, the impacts are decayed, and the impacts give rise to a small amount of electric charge.

FIG. 3 shows the relation between the beaten spot and the signal level. Plots PL1 is indicative of the signal level in terms of the beaten spot. When a player beats the center of the surface 100*a* at the predetermined magnitude of impacts, the electric signal exhibits the maximum signal level. The beaten spot is spaced from the center of the surface 100*a*, i.e., the distance of zero without changing the magnitude of the impacts. Then, the signal level is reduced as indicated by plots PL1. Thus, the local dependency is serious in the first prior art electronic drum.

FIGS. 4 and 5 shows another drum pad 120 incorporated in the second prior art electronic percussion instrument. The drum pad 120 exhibits a fairly flat signal level in terms of the beaten spots. The drum pad 120 also largely comprises a pad 121*a* and an impact sensor 121*b*. The pad 121*a* is similar to the pad 111*a*, and includes a rigid plate 122 of iron and a rubber layer 123 adhered to the top surface of the rigid plate 122. The rubber layer 123 offers a major surface 120*a* to a player.

The impact sensor 121*b* is different from the impact sensor 111*b*. The impact sensor 121*b* includes filter elements 125, a sensor boat 126, a piezoelectric converter 124 and a signal output cable 124*a*. The sensor boat 126 is made of synthetic resin, which exhibits a small internal loss. The sensor boat 126 is wider than the piezoelectric converter 124. The sensor boat 126 is adhered to the reverse surface of the rigid plate 122 by means of filter elements 125. The filter elements 125 are spaced from one another on the reverse surface of the rigid plate 122. The piezoelectric converter 124 is adhered to the sensor boat 126.

When a player beats the major surface 120*a* with sticks, the vibrations take place in the rigid plate 122, and reach the sensor boat 126 through the filter elements 125. The vibrations of the sensor boat 126 give rise to the stress in the piezoelectric converter 124, and the electric charge flows out from the piezoelectric converter 124 as the electric signal.

Since the wide area is assigned to the filter elements 125, the vibrations reach any one of the filter elements 125, and the difference in vibration propagating length is shorter than that on the drum pad 100. As a result, plots PL2 do not exhibit a sharp peak, but form a tableland as shown in FIG. 6. While the player is beating the central area on the major surface 120*a* over the sensor boat 126, the loudness of the drum sound is fairly constant regardless of the beaten spots. Thus, the local dependency is improved rather than that of the first prior art electronic drum. However, when the player moves the sticks from the central area to the peripheral area, the loudness is reduced as similar to the drum pad 100.

The sensor boat 126 makes the area assigned to the filter elements 125 wider than the contact area between the sheet of adhesive double coated tape 115 and the reverse surface of the rigid plate 112. This results in the improvement of the local dependency. A drum pad 130 shown in FIGS. 7 and 8 has a sensor boat 136 much wider than the sensor boat 126, and the sensor boat 136 further improves the local dependency as indicated by plots PL3 in FIG. 9.

The drum pad 130 also largely comprises a pad 131*a* and an impact sensor 131*b*. The pad 131 includes a rigid plate 132 and a rubber layer 133 as similar to the pads 111/121. The impact sensor 131*b* includes the wide sensor boat 135, filter elements 135, a piezoelectric converter 134 and a signal output cable 134*a*. The piezoelectric converter 134 is adhered to the sensor boat 136, which in turn is adhered to the reverse surface of the rigid plate 132 by means of the filter elements 135.

The sensor boat 136 is made of material with an internal loss equal to or greater than 0.02, and has a disc shape. Vinyl chloride foam exhibits the internal loss equal to or greater than 0.02. The material with the large internal loss is preferable for the filter elements 135, because the sensor boat 136 exhibits a small value in the resonance sharpness. This means that any serious resonance hardly takes place. In other words, the sensor boat 136 uniformly propagates the vibrations to the piezoelectric converter 134.

The filter elements 135 are made of butyl rubber, and have either rectangular or elliptic configuration. The filter elements 135 are spaced from one another along the circular periphery of the sensor boat 136 at regular intervals, and have the longitudinal directions aligned with the radial directions of the sensor boat 136. The arrangement of the filter elements 135 is preferable for the propagation of vibrations to the piezoelectric converter 134, because the vibrations are propagated through the filter elements toward the piezoelectric converter 134. The filter elements 135 are adhered to the reverse surface of the rigid plate 132, and the wide sensor boat 136 are adhered to the filter elements 135 as described hereinbefore.

A player is assumed to beat the major surface 130*a*. Even though the player changes the beaten spot over the major surface 130*a*, the signal level is constant in so far as the magnitude of impacts is not changed as indicated by plots PL3 in FIG. 9. Since the long filter elements 135 are held in contact with the peripheral area of the sensor boat 136, this arrangement make the distances between the beaten spots and the closest one of the filter elements 135 equalized over the major surface 130*a*. For this reason, the amount of decay is constant regardless of the beaten spots. This results in the improvement of the local dependency.

A problem inherent in the prior art drum pad 120 is the local dependency left in the peripheral area on the major surface 120*a*. Although the local dependency is fairly improved in the central area, viz., the area over the sensor boat 126, the local dependency is still serious in the peripheral area. Another problem is unstable vibration propagating characteristics of the sensor boat 126. The sensor boat 126 is made of the synthetic resin, which has a small internal loss, so that the sensor boat 126 exhibits a large value in the resonance sharpness. While the sensor boat 126 is propagating the vibrations, the nodes and antinodes take place due to the resonance sharpness, and are moved depending upon the beaten spots. For this reason, the local dependency is still left in the electric signal.

The drum pad 130 is free from the local dependency. The electric signal keeps the constant potential level over the major surface 130 in so far as the player beats the major surface 130*a* at the constant magnitude of impacts. However, another problem is encountered in the third prior art electronic drum in that an electric signal exhibits serious local dependency at rim shots. Though not shown in FIGS. 7 and 8, the rim has a ring-shaped, and the pad 131*a* is surrounded by the rim, which is usually made of metal or alloy. The player hits the rim with the stick or sticks during his or her performance. This sticking is called as "rim shot". In order to discriminate the beats on the pad 111*a*/121*a*/131*a* from the rim shots, the beats on the pad 111*a*/112*a*/113*a* are hereinbelow referred to as "pad shots".

Another impact sensor (not shown) is attached to the rim, and converts the vibrations to the electric signal. The local dependency at the rim shots is reasoned as similar to that on the pad 111*a*. The vibrations at the rim shot are propagated through the rim to the impact sensor, and the distance between the beaten spot and the impact sensor is not constant. When the player beats the rim at a certain spot far from the impact sensor, the vibrations are propagated over a long distance, and are liable to be decayed. On the other hand, if the player beats the rim at another spot close to the impact sensor, the vibrations immediately reach the impact sensor, and are less decayed.

If the rim were wide enough to support a sensor boat, the local dependency would be improved. However, the rim is thin like a hoop. It is hard to use the sensor boat.

Another problem is a small and narrow potential range of the electric signal. The sensor boat 136 is so large and heavy that the force exerted on the pad 131 can not violently excite the sensor boat 136. Only small stress is exerted on the piezoelectric converter 134, and the piezoelectric converter 134 generates a small amount of electric charge. This results in the small and narrow potential range of the electric signal. Of course, if a large-sized piezoelectric converter 134 is used, the large-sized piezoelectric converter 134 widely swings the potential level. However, such a large-sized piezoelectric converter 134 is expensive. Thus, the sensor boat 136 of the large inter loss material is less preferable to the piezoelectric converter 134.

The applicant has searched the database for related documents. Karch discloses an electric fabricated on the basis of an acoustic drum in U.S. Pat. No. 5,042,356. The prior art electric drum has impact sensors attached to a central area and a peripheral area of the reverse surface of a pad. The impact sensors are labeled with reference numerals 20 and 24 in the U.S. patent, respectively. Although Karch is silent to how the impact sensors are held in contact with the reverse surface of the pad, it is sure that Karch does not teach any impact sensor supported in a cantilever fashion.

Another document is U.S. Pat. No. 5,345,037 to Nordelius. Nordelius discloses an acoustic drum transmitter including a vibration sensitive body labeled with reference numeral 8 in the U.S. patent. The vibration sensitive body 8 is fixed to the drum head 10 by means of a holder 3, a hook 4 and a screw 7 as described in column 3, lines 18 to 21. The vibration sensitive body 8 is seemed to be held in contact with the drumhead 10 through its entire surface. The applicant thinks the vibration sensitive body 8 not to be supported in a cantilever fashion.

SUMMARY OF THE INVENTION

It is therefore an important object of the present invention to provide an electronic percussion instrument, which is free from the local dependency without use of a large-sized piezoelectric converter.

It is also an important object of the present invention to provide an electronic percussion system, which includes the electronic percussion instrument.

It is yet another important object of the present invention to provide an electric percussion instrument, which detects pad shots and rim shots without influences of the local dependency on an output electric signal.

In accordance with one aspect of the present invention, there is provided an electronic percussion instrument for generating an electric signal representative of vibrations comprising a vibration propagating member to be struck for generating vibrations, a connector having a first surface connected to the vibration propagating member and a second surface, and a vibrations-to-electric signal converter having a surface partially connected to the second surface and partially projecting from the connector so as to be spaced from the vibration propagating member and shaken in the presence of the vibrations for enlarging the magnitude of an electric signal output therefrom.

In accordance with another aspect of the present invention, there is provided an electronic percussion instrument for generating a first electric signal representative of first vibrations and a second electric signal representative of second vibrations comprising a first vibration propagating member to be struck for generating the first vibrations, a second vibration propagating member to be struck for generating the second vibrations, a first connector having a first surface receiving the first vibrations from the first vibration propagating member and a second surface onto which the first vibrations are transmitted from the first surface, a first vibrations-to-electric signal converter connected to the second surface of the first connector in a cantilever fashion and shaken in the presence of the first vibrations for enlarging a magnitude of the first electric signal, a second connector having a third surface receiving the second vibrations from the second vibration propagating member and a fourth surface onto which the second vibrations are transmitted, and a second vibrations-to-electric signal converter connected to the fourth surface in a cantilever fashion and shaken in the presence of the second vibrations for enlarging a magnitude of the second electric signal.

In accordance with yet another aspect of the present invention, there is provided an electronic percussion system for generating electronic percussion sound comprising an electronic percussion instrument generating an electric signal representative of vibrations and including a vibration propagating member to be struck for generating vibrations, a connector having a first surface receiving the vibrations from the vibration propagating member and a second surface onto which the vibrations are transmitted from the first surface and a vibrations-to-electric signal converter connected to the second surface in a cantilever fashion and shaken in the presence of the vibrations for enlarging a magnitude of the electric signal, and an electronic sound generating system connected to the vibrations-to-electric signal converter, analyzing the electric signal to see whether or not the vibration propagating member is struck, generating music data codes representative of beats on the vibration propagating member, producing an audio signal representative of the electronic percussion sound on the basis of the music data codes and converting the audio signal to the electronic drum sound.

BRIEF DESCRIPTION OF THE DRAWINGS

The features and advantages of the electronic percussion instrument and electronic percussion system will be more clearly understood from the following description taken in conjunction with the accompanying drawings, in which.

DESCRIPTION OF THE PREFERRED EMBODIMENTS

First Embodiment

Figure 10:
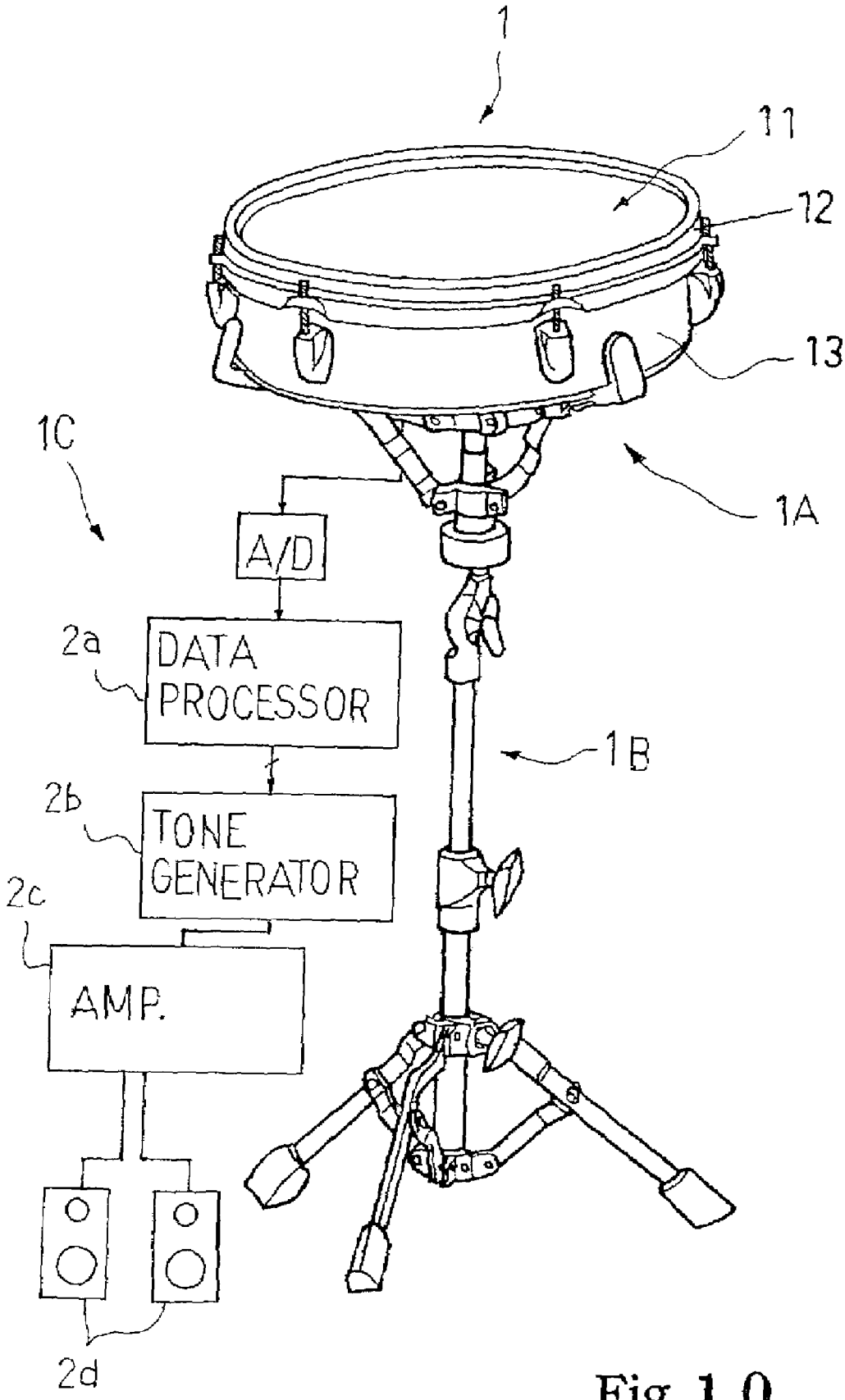
FIG. 10 is a perspective view showing the structure of an electronic drum system according to the present invention.
Figure 12:
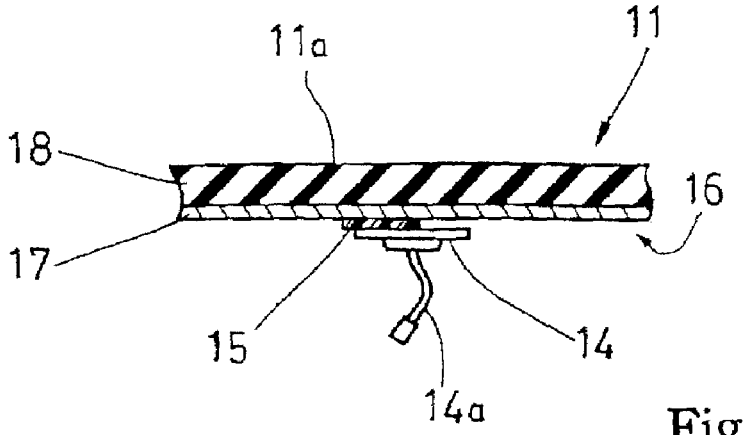
FIG. 12 is a cross sectional view taken along ling D—D of FIG. 11 and showing the structure of the drum pad.
Figure 11:
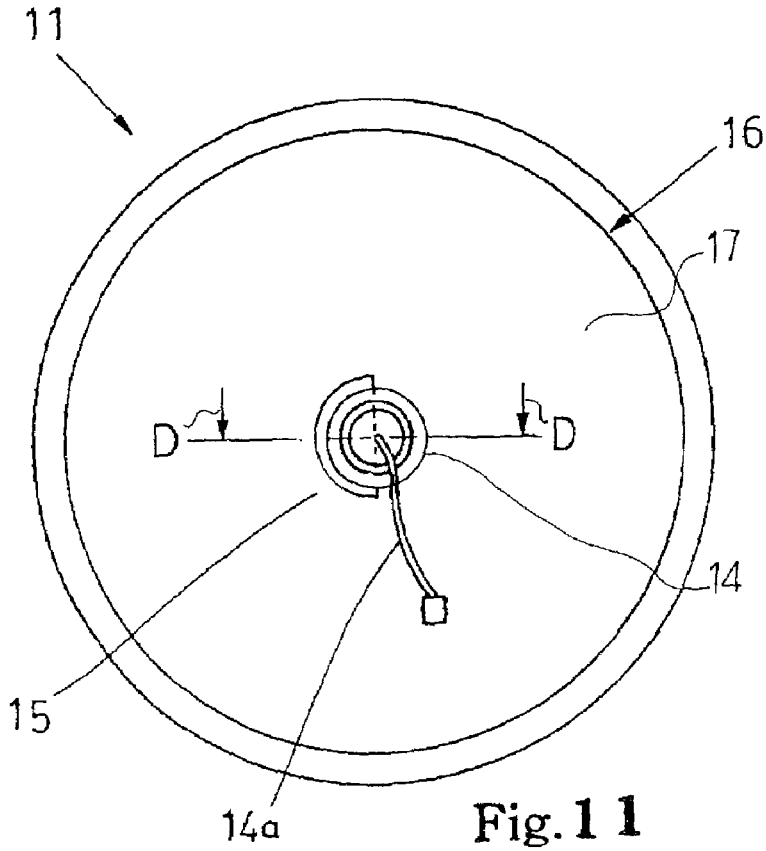
FIG. 11 is a bottom view showing an impact sensor secured to a pad forming a part of an electronic drum according to the present invention.

Referring to figures 10, 11 and 12 of the drawings, an electronic drum system embodying the present invention is shown and generally indicated at 1. The electronic drum system 1 largely comprises an electronic drum 1A, a snare stand 1B and an electronic sound generating system 1C. The electronic drum 1A has an external appearance like an acoustic snare drum. The snare stand 1B is upright on a floor, and supports the electronic drum 1A. The electronic sound generating system 1C is connected to the electronic drum 1A, and processes an electric signal representative of the waveform of vibrations for generating electronic drum sound.

When a drummer wants to beat the electronic drum 1A, he or she puts the electronic drum 1A on the snare stand 1B, and connects the electronic sound generating system 1C to the electronic drum 1A. While the drummer is beating the electronic drum 1A, the electronic drum 1A varies the potential level of the electric signal, and the supplies the electric signal to the electronic sound generating system 1C. The electronic sound generating system 1C analyzes the electric signal for each beat, and produces music data codes representative of the beats. The digital audio signal representative of the drum sound is produced on the basis of the music data codes, and is converted to an analog audio signal. The analog audio signal is converted to the electronic drum sound, and the electronic drum sound is radiated from the electronic sound generating system 1C.

The snare stand is similar to that of an acoustic snare drum, and no further description is incorporated hereinafter. The electronic sound generating system 1C includes an analog-to-digital converter A/D, a data processor 2*a*, a tone generator 2*b*, amplifiers 2*c* and loud speakers 2*d*. The analog-to-digital converter A/D receives the electric signal supplied from the electronic drum 1A, and the electric signal is converted to a series of data codes representative of the momentary discrete magnitude on the waveform of the electric signal. The analog-to-digital converter A/D supplies the data codes to the digital processor 2*a*. The data processor 2*a* fetches the data codes, and analyzes them to see whether or not the drummer strikes the electronic drum 1A with sticks. When the drummer strikes the electronic drum 1A with the sticks, a peak is produced in the waveform of the electric signal, and the data processor 2*a* acknowledges the peak through the analysis on the data codes. Then, the data processor 2*a* produces the music data codes representative of the peaks, and supplies the music data codes to the tone generator 2*b*.

Figure 13:
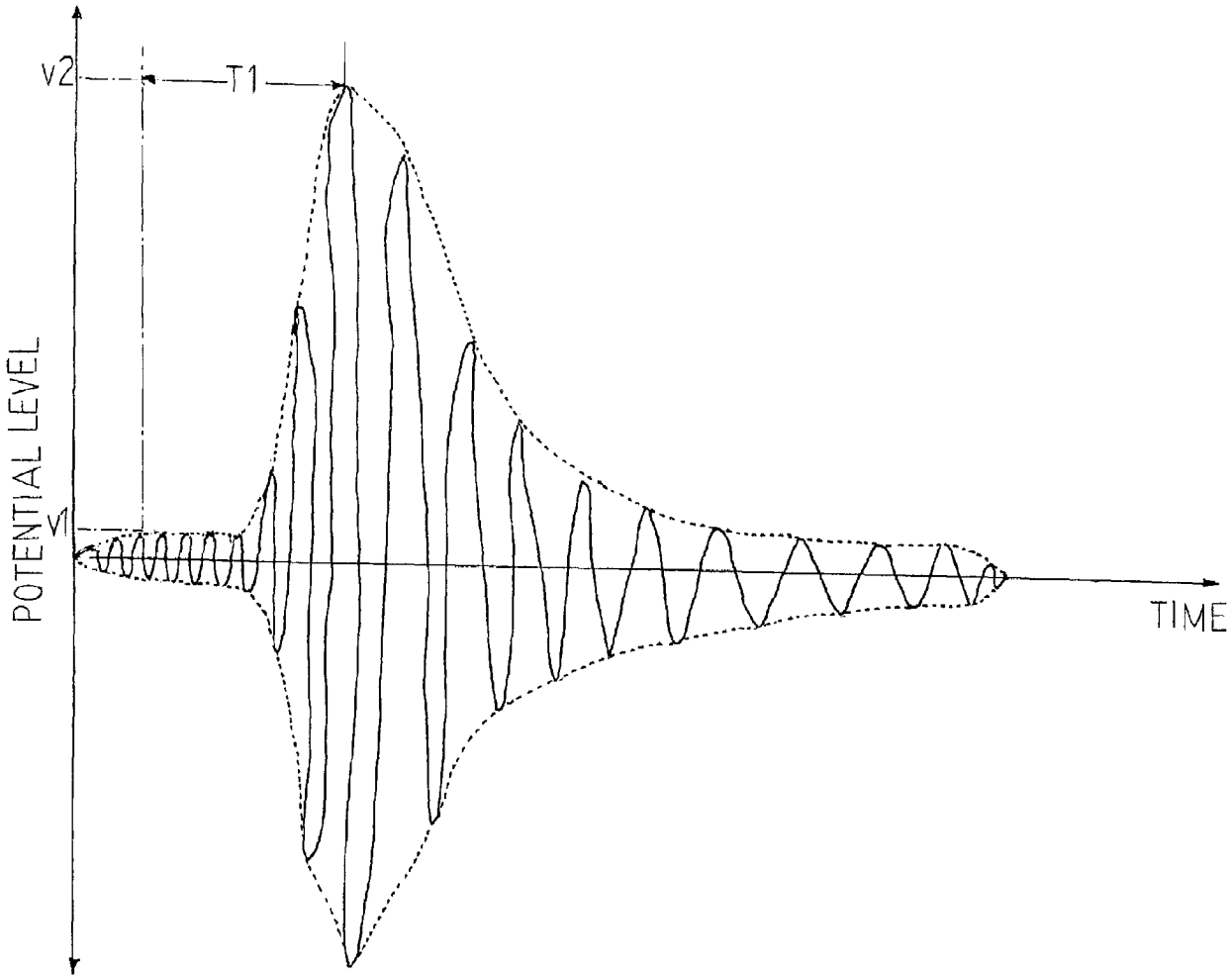
FIG. 13 is a view showing a waveform of an electric signal output from a piezoelectric converter.

FIG. 13 shows a waveform of the electric signal at a pad shot. Upon impact against the electronic drum 1A, the electric signal starts to oscillate, and the analog-to-digital converter A/D starts to convert the momentary discrete value to the data code. The electric signal restricts the amplitude within a small range for 0.5 millisecond to a few milliseconds. When the data code representative of the amplitude exceeds a threshold v1, the data processor 2*a* acknowledges the pad shot, and waits for a predetermined time period T1. The predetermined time period T1 is experimentally determined such that the potential level is peaked at the expiry of the predetermined time period T1. The predetermined time period T1 is usually fallen within 2 milliseconds to 5 milliseconds. When the predetermined time period T1 is expired, the data processor 2*a* compares the value represented by the data code with a threshold value to see whether or not the potential level exceeds the threshold. If the answer is given negative, the data processor decides that the electric signal merely represents noise, and does not produce any music data code. If, on the other hand, the answer is given affirmative, the data processor 2*a* produces the music data code or codes representative of the drum sound, and supplies the data code or codes to the tone generator 2*b*. The electric signal is gradually decayed after the peak v2.

The tone generator 2*b* is responsive to the music data codes so as to produce the digital audio signal representative of the electronic drum sound on the basis of the music data codes. The digital audio signal is converted to the analog audio signal, and the analog audio signal is supplied to the amplifiers 2*c*. The amplifiers 2*c* equalize and amplify the analog audio signal, and, thereafter, the analog audio signal is converted to the electronic drum sound through the loud speakers 2*d*.

Subsequently, description is made on the electronic drum 1A. The electronic drum 1A includes a drum pad 11, a rim 12 and a shell 13. The drum pad 11 is a thin flexible disc, and the shell 13 is rigid and cylindrical. The rim 12 is also rigid, and is like a hoop. The drum pad 11 is stretched over the shell 13, and is secured to the shell 13 by means of the rim 12. Those component parts 11/12/13 make the electronic drum 1A leave an impression like the acoustic snare drum on users.

The drum pad 11 includes a piezoelectric converter 14, a filter element 15 and a pad body 16. The arrangement of these components 14, 15 and 16 are illustrated in FIGS. 11 and 12. The piezoelectric converter 14 converts the stress exerted thereon to electric charge, and the electric charge flows out from the piezoelectric converter 14 as the electric signal. A signal cable 14*a* is connected to the piezoelectric converter 14 for propagating the electric signal to the electronic sound generating system 1C. The pad body 16 has a rigid plate 17 and a resilient layer 18. The rigid plate 17 is made of metal such as iron or steel, and the resilient layer 18 is made of rubber. The rigid plate 17 is overlaid with the resilient layer 18, and the resilient layer 18 offers a major surface 11*a* to be beaten to a drummer. The filter element 14 is made of resilient material such as, for example, rubber, and is operative to eliminate high frequency vibration components from the vibrations during the transfer from the rigid plate 17 to the piezoelectric converter 14.

Figure 1:
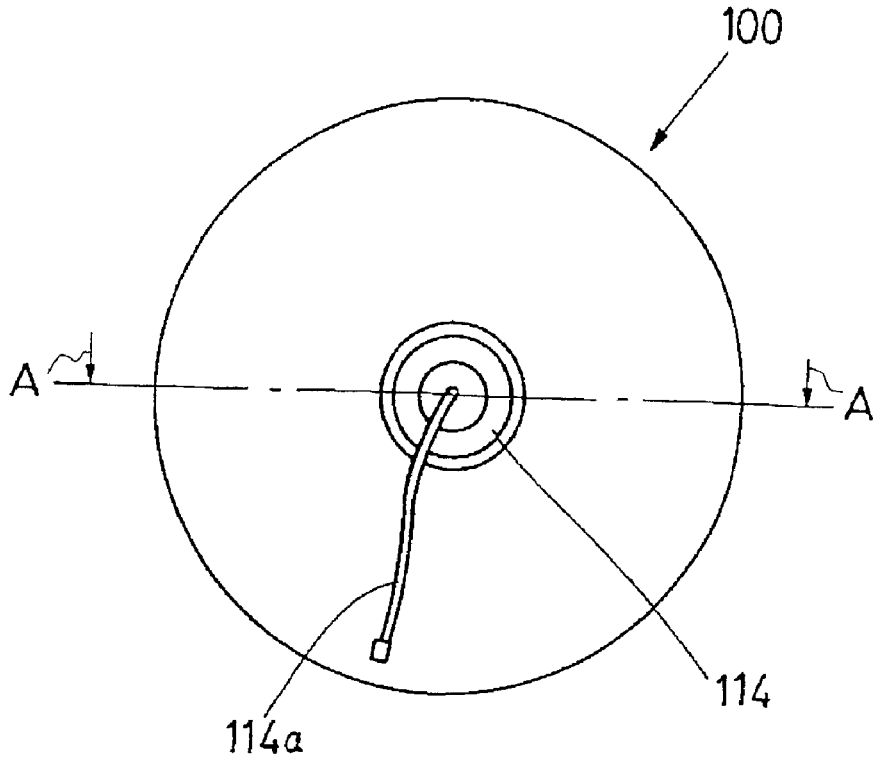
Fig. 1 PRIOR ART
FIG. 1 is a bottom view showing the drum pad of the first prior art electronic percussion instrument.
Figure 2:
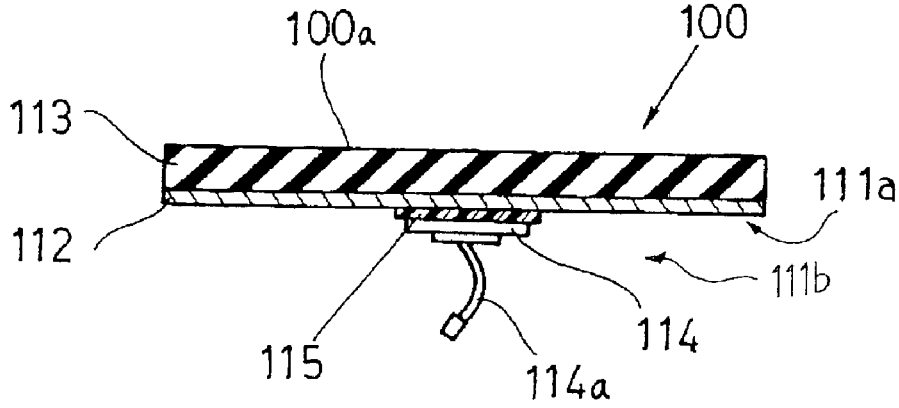
Fig. 2 PRIOR ART
FIG. 2 is a cross sectional view taken along line A—A of FIG. 1 and showing the structure of the drum pad.
Figure 3:
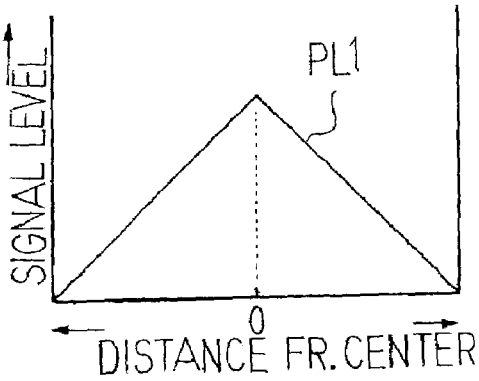
Fig. 3 PRIOR ART
FIG. 3 is a graph showing the relation between the signal level and the distance between the beaten spot and the center of the drum pad.
Figure 6:
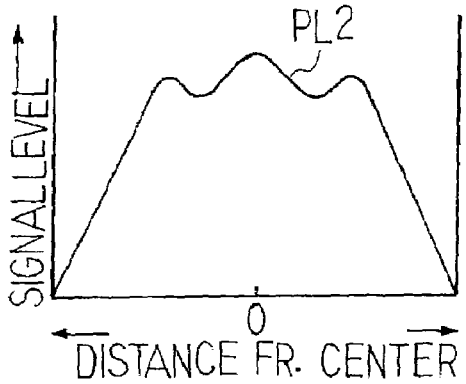
Fig. 6 PRIOR ART
FIG. 6 is a graph showing the relation between the signal level and the distance between the beaten spot and the center of the drum pad.
Figure 9:
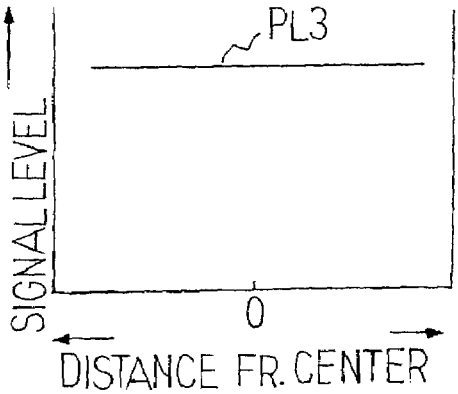
Fig. 9 PRIOR ART
FIG. 9 is a graph showing the relation between the signal level and the distance between the beaten spot and the center of the drum pad.
Figure 4:
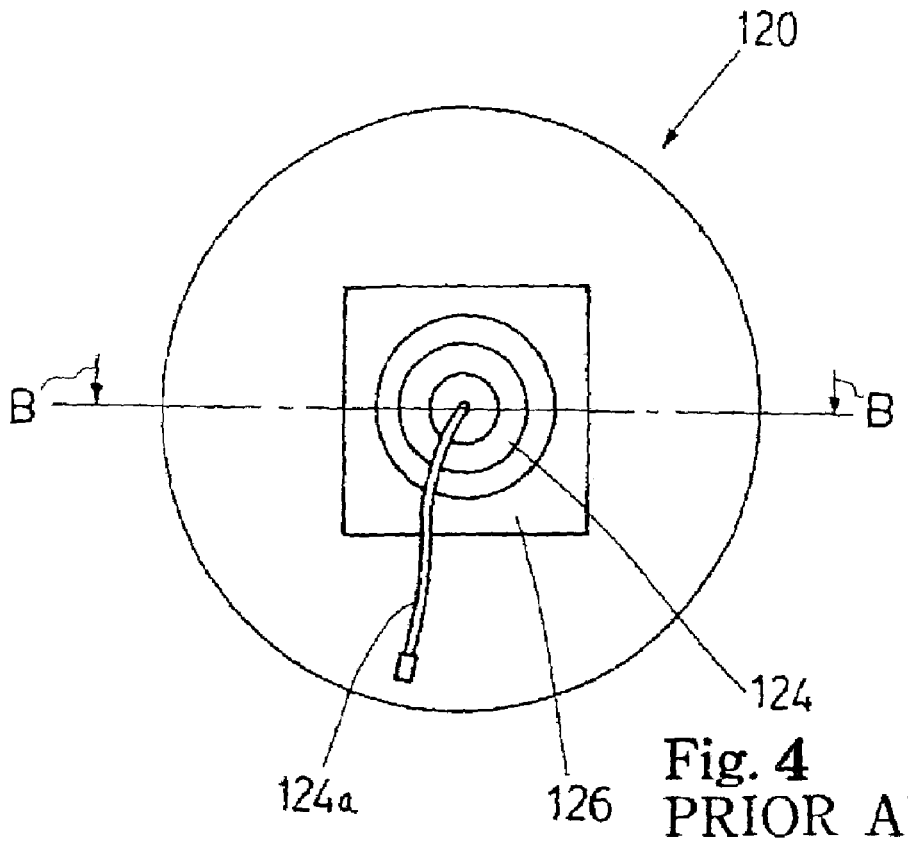
Fig. 4 PRIOR ART
FIG. 4 is a bottom view showing the drum pad of the second prior art electronic percussion instrument.
Figure 5:
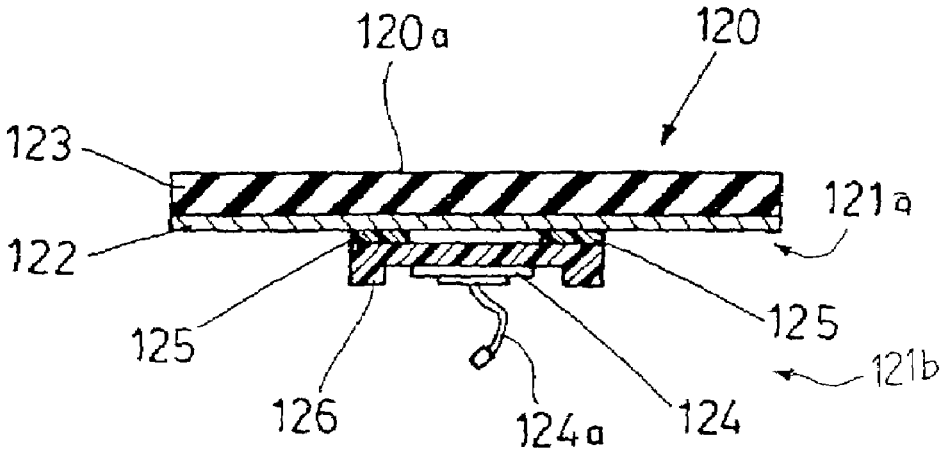
Fig. 5 PRIOR ART
FIG. 5 is a cross sectional view taken along line B—B of FIG. 4 and showing the structure of the drum pad.
Figure 7:
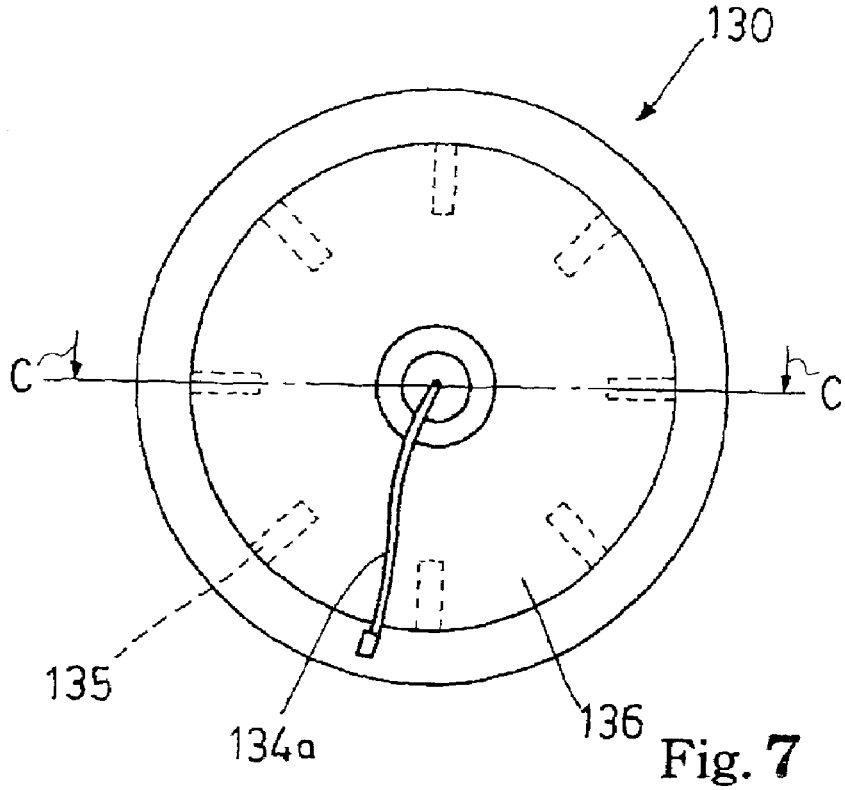
Fig. 7 PRIOR ART
FIG. 7 is a bottom view showing the drum pad incorporated in the third prior art electronic percussion instrument.
Figure 8:
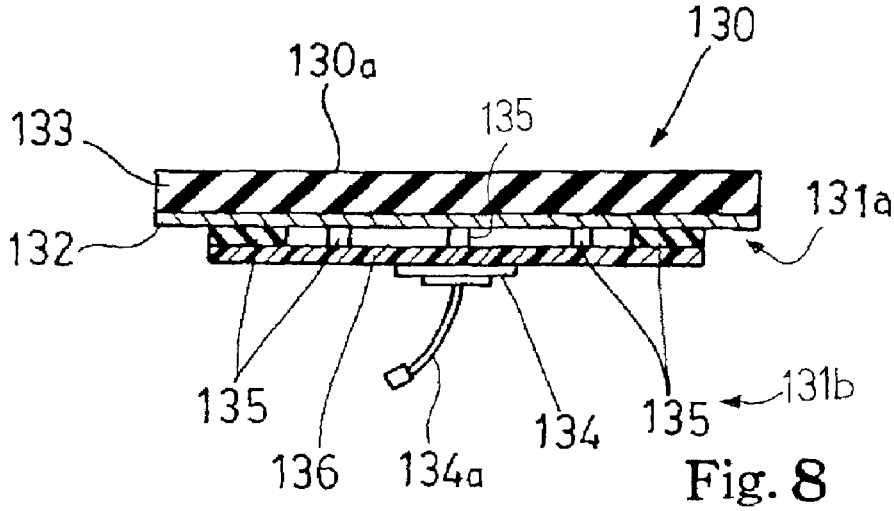
Fig. 8 PRIOR ART
FIG. 8 is a cross sectional view taken along line C—C of FIG. 7 and showing the structure of the drum pad.

The filter element 15 has adhesive compound layers, and is further operative to adhere the piezoelectric converter 14 to the reverse surface of the rigid plate 17. In detail, the piezoelectric converter 14 has a semi-circular configuration, and the filter element 15 has a circular configuration. The diameter of the filter element 15 is equal to or slightly greater than the diameter of the piezoelectric converter 14. The filter element 15 is adhered to the reverse surface of the rigid plate 17. The piezoelectric converter 14 is coaxially adhered to the filter element 15. The half of the piezoelectric converter 14 is held in contact with the filter element 15, and the other half is overhung under the reverse surface of the rigid plate 17. In other words, the other half of the piezoelectric converter 14 is spaced from the reverse surface of the rigid plate 17. The piezoelectric converter 14, which is partially overhung under the rigid plate 17, is hereinafter referred to as "cantilever converter", and a piezoelectric converter, which is perfectly held in contact with the filter element as similar to the piezoelectric converter 114 (see FIG. 2), is hereinafter referred to as "overlapped converter".

Assuming now that a drummer strikes the drum pad 11 with a stick, the stick gives a strong impact to the rigid plate 17, and gives rise to vibrations. The strong impact makes the drum pad 11 moved in the up-and-down direction together with the cantilever converter 14, and the vibrations are propagated through the rigid plate 17 and filter element 15 to the cantilever converter 14. The up-and-down motion due to the strong impact is hereinafter referred to as "wave". Even if the cantilever converter 14 is replaced with the overlapped converter, the strong impact makes the drum pad 11 moved in the up-and-down direction together with the overlapped converter, and the vibrations are transmitted through the rigid plate 17 to the overlapped converter. Thus, both of the wave and vibrations reach the cantilever converter 14 and overlapped converter. However, the stress on the cantilever converter 14 is much larger than the stress on the overlapped converter. This is because of the fact that the wave gives rise to the stress only in the cantilever converter 14.

In detail, when the vibrations reach the overlapped converter and cantilever converter 14, the vibrations give rise to bending moment in both of the overlapped converter and cantilever converter 14, and the bending stress is equally generated in both of the overlapped converter and the cantilever converter 14. Thus, the vibrations are influential in generating the electric charge between the overlapped converter and the cantilever converter 14.

On the other hand, the wave is valid only in the cantilever converter 14. When the wave gives rise to the up-an-down motion of the cantilever converter 14, the overhung piezoelectric element is shaken, and is repeatedly bent. The bending stress is exerted on the overhung piezoelectric element, and the electric charge is generated in the overhung piezoelectric element. However, the overlapped converter is merely moved together with the drum pad 11. Any bending stress is not exerted on the piezoelectric converter. Thus, the total amount of electric charge in the cantilever converter 14 is much more than the total amount of electric charge in the overlapped converter. In other words, the cantilever converter 14 widely swings the electric signal rather than the overlapped converter do.

The filter element 15 is not so large as the sensor boat 136. This means that the vibrations are still under the influence of the difference in distance between the beaten spots. When the drummer strikes a peripheral area of the drum pad 11 with a stick, the vibrations are partially decayed, and the magnitude of vibrations at the filter element 15 is smaller than the magnitude of vibrations propagated from the center of the drum pad 11. The vibrations propagated from a peripheral area of the drum pad 11 is hereinbelow referred to "weak vibrations", and the vibrations propagated from the center of drum pad 11 is referred to as "strong vibrations". The amount of electric charge due to the strong vibrations may be more than the amount of electric charge due to the weak vibrations. However, the wave due to the impact at the center of the drum 11 is as wide as the wave due to the impact in the peripheral area. In other words, the wave due to the impact at the center of the drum 11 gives rise to generation of the electric charge as much as the electric charge generated due to the wave at the impact against the peripheral area.

Although the amount of electric charge generated through the vibrations are different between the impact at the center of the drum pad 11 and the impact in the peripheral area, the electric charge due to the wave makes the difference ignoreable. For this reason, the local dependency of the electronic drum according to the present invention is less than that of the prior art electronic drums.

The present inventor evaluated the overhung piezoelectric converter 14. The present inventor gave impacts along a virtual line passing through the center of the drum pad 11. Each impact gave rise to waves and vibrations. The waves made the overhung piezoelectric converter 14 shaken. The vibrations were propagated through the drum pad 11 to the filter element 15, and reached the overhung piezoelectric converter 14. The waves and vibrations excited the overhung piezoelectric converter 14, and drove the overhung piezoelectric converter 14 to repeatedly bend. The stress was converted to the electric signal, which in turn was converted to a series of the data codes. The values of the data codes were plotted on the virtual line, and confirmed that the plots formed a linear line. Thus, the present inventor confirmed that the overhung piezoelectric converter 14 was effective against the local dependency.

Figure 14:
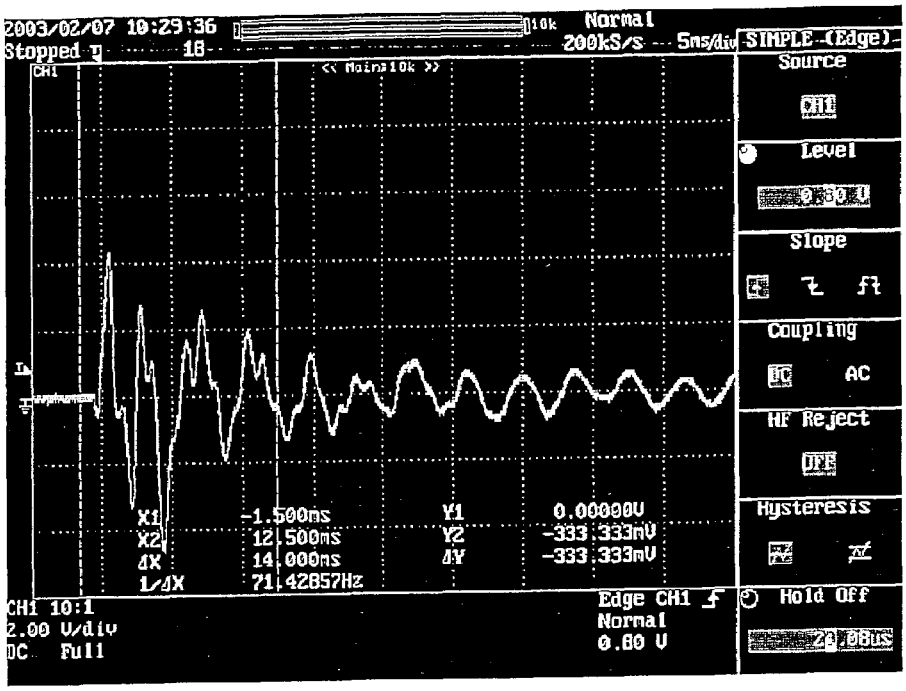
Fig. 14 PRIOR ART
FIG. 14 is a graph showing the waveform of the electric signal produced by an overlapped piezoelectric converter.
Figure 15:
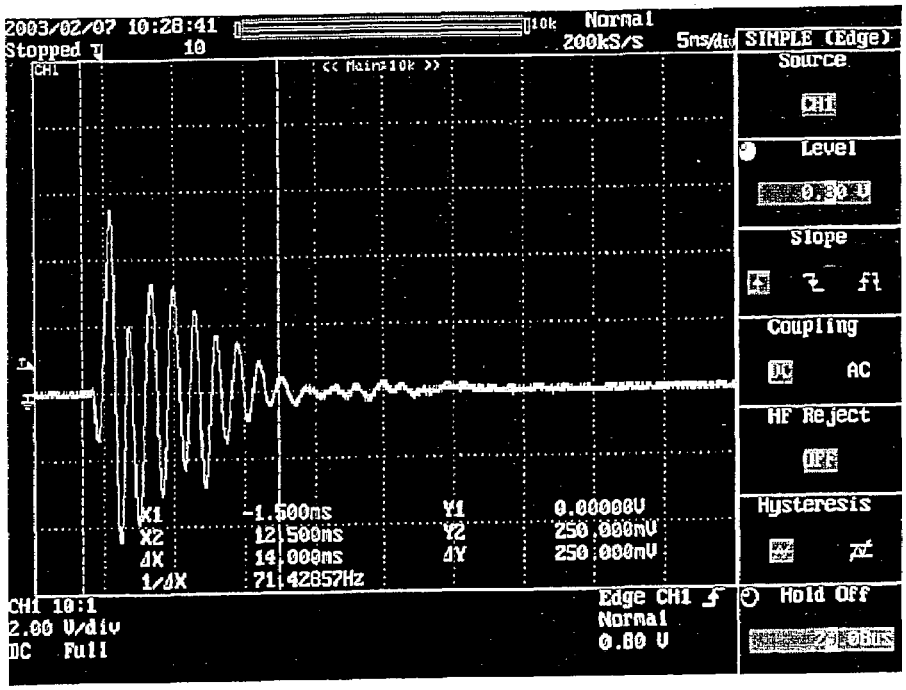
FIG. 15 is a graph showing the waveform of the electric signal produced by an overhung piezoelectric converter.

The present inventor further investigated the influence of the filter element 15 on the piezoelectric converter. The present inventor prepared a sample with the overhung piezoelectric converter 14 and another sample with the overlapped piezoelectric converter, and measured the electric signal. When an impact was given onto the drum pad, the overlapped piezoelectric converter varied the electric signal as shown in FIG. 14. On the other hand, when the impact was give onto the same beaten spot of the drum pad 11, the overhung piezoelectric converter 14 varied the electric signal as shown in FIG. 15. Comparing the waveform shown in FIG. 14 with the waveform shown in FIG. 15, ripples were observed in the waveform shown in FIG. 14, and were eliminated from the waveform shown in FIG. 15. Moreover, the electric signal shown in FIG. 14 was gradually decayed, and the electric signal shown in FIG. 15 was rapidly decayed. From the observation, the present inventor concluded that the semi-circular filter element 15 was preferable for the electronic drum, because the semi-circular filter element 15 eliminated the high-frequency vibration components from the input vibrations. The semi-circular filter element 15 was further preferable for the electronic drum, because the electronic drum promptly responded to the beats through the quick decay.

As will be understood from the foregoing description, the overhung piezoelectric converter 14 enlarges the stress through the self-excitation under the application of the vibrations, and a small-sized piezoelectric converter 14 produces the electric signal with a large peak value. Moreover, the local dependency is canceled through the amplification of the stress. Thus, the electronic drum system 1 according to the present invention is free from the local dependency without a large-sized piezoelectric converter.

Second Embodiment

Figure 16:
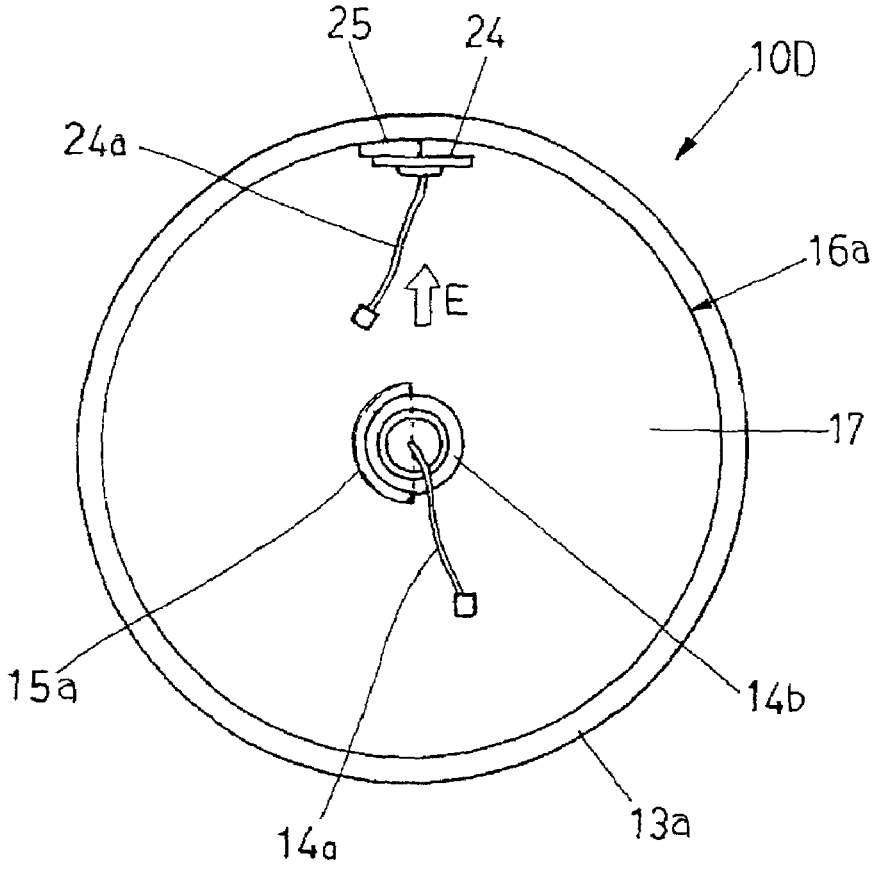
FIG. 16 is a bottom view showing the arrangement on the reverse surface of an electronic drum forming a part of another electronic drum system according to the present invention.
Figure 17:
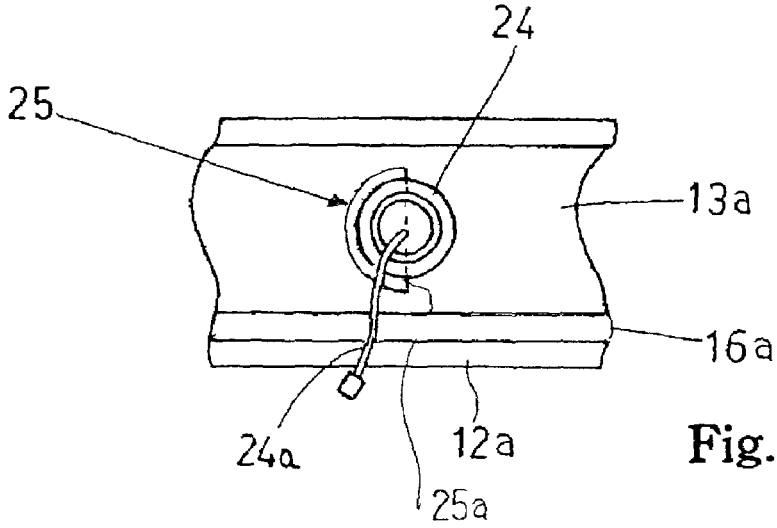
FIG. 17 is an internal side view showing an overhung piezoelectric converter attached to a shell of the electronic drum seen in a direction indicated by arrow E.

Turning to FIGS. 16 and 17 of the drawings, another electronic drum 10D forms a part of another electronic drum system embodying the present invention. Although the electronic drum system implementing the second embodiment further comprises a snare stand and an electronic sound generating system, the snare stand and electronic sound generating system are similar to those 1B/1C of the electronic drum system 1, and description on the snare stand and electronic sound generating system is omitted for avoiding repetition.

The electronic drum 10D includes a rim 12*a*, a shell 13*a*, an overhung piezoelectric converter 14*b*, a filter element 15*a* and a drum pad 16*a*. The rim 12*a*, shell 13*a*, overhung piezoelectric converter 14*b*, filter element 15*a* and drum pad 16*a* are similar to those of the drum pad 10, and no further description is hereinafter incorporated for the sake of simplicity. The component parts of the/overhung piezoelectric converter and drum pad 14*b*/16*a* are labeled with the references designating the corresponding component parts of the overhung piezoelectric converter and drum pad 14/16 without detailed description.

The electronic drum 10D further includes an impact sensor for detecting the rim shots. The impact sensor is implemented by a circular overhung piezoelectric converter 24 and a semi-circular filter element 25. The semi-circular filter element 25 is made of resilient material such as, for example, rubber, and has a diameter equal to or slightly greater than the diameter of the circular piezoelectric converter 24. The semi-circular filter element 25 is gently warped so as to be tightly adhered thereto. The semi-circular filter 25 is designed to be thick enough to prevent the circular piezoelectric converter 24 from undesirable contact with the inner surface of the shell 13 during the vibrations.

The semi-circular filter element 25 is adhered to the inner surface of the shell 13*a* in such a manner that the straight end line 25*a* extend in a direction normal to the drum pad 16*a*. When a drummer gives a rim shot, the vibrations are spread in the direction of the circular periphery of the shell 13*a*. The vibrations strongly shake the overhung piezoelectric converter 24 rather than an overhung piezoelectric converter with the straight end line 90 degrees different from the straight end line 25*a*. The circular piezoelectric converter 24 is coaxially adhered to the semi-circular filter element 25. The circular piezoelectric converter 24 is partially adhered to the filter element 25, and is partially spaced from the internal surface of the shell 13.

A signal cable 24*a* is connected to the overhung piezoelectric converter 24, and is connected to the electronic sound generating system 10C. Thus, the signal cables 14*a* and 24*a* are connected to the analog-to-digital converter A/D so that two series of data codes are supplied to the data processor 2*a*. The data processor 2*a* periodically fetches the two series of data codes, and analyzes them for detecting the pad shots and rim shots.

The overhung piezoelectric converter 14*b* behaves for detecting the pad shots as similar to the overhung piezoelectric converter 14. The rim shots are detected through the other overhung piezoelectric converter 24. A drummer is assumed to give a rim shot onto the rim 12. The rim shot gives rise to vibrations in the rim 12, and the vibrations are transmitted from the rim 12 to the shell 13. The vibrations are spread in the shell in the direction in which the inner surface of the shell 13 extends. When the vibrations reach the semi-circular filter 25, the semi-circular filter 25 eliminates high frequency vibration components from the input vibrations, and transfers them to the overhung piezoelectric converter 24. The vibrations give rise to the bending stress in the piezoelectric converter 24 held in contact with the semi-circular filter element 25, and shake the other half of the circular piezoelectric converter 24. Thus, the vibrations excite the overhung piezoelectric converter 24, and strong stress is generated in the overhung piezoelectric converter 24. As a result, the local dependency is eliminated from the electric signal, and the peak value of the electric signal is substantially constant regardless of the beaten spots over the rim 12.

Thus, the electronic drum system implementing the second embodiment exactly detects the rim shots, and achieves all the advantages of the electronic drum system 1 by virtue of the overhung piezoelectric converter 14*b*.

Third Embodiment

Figure 18:
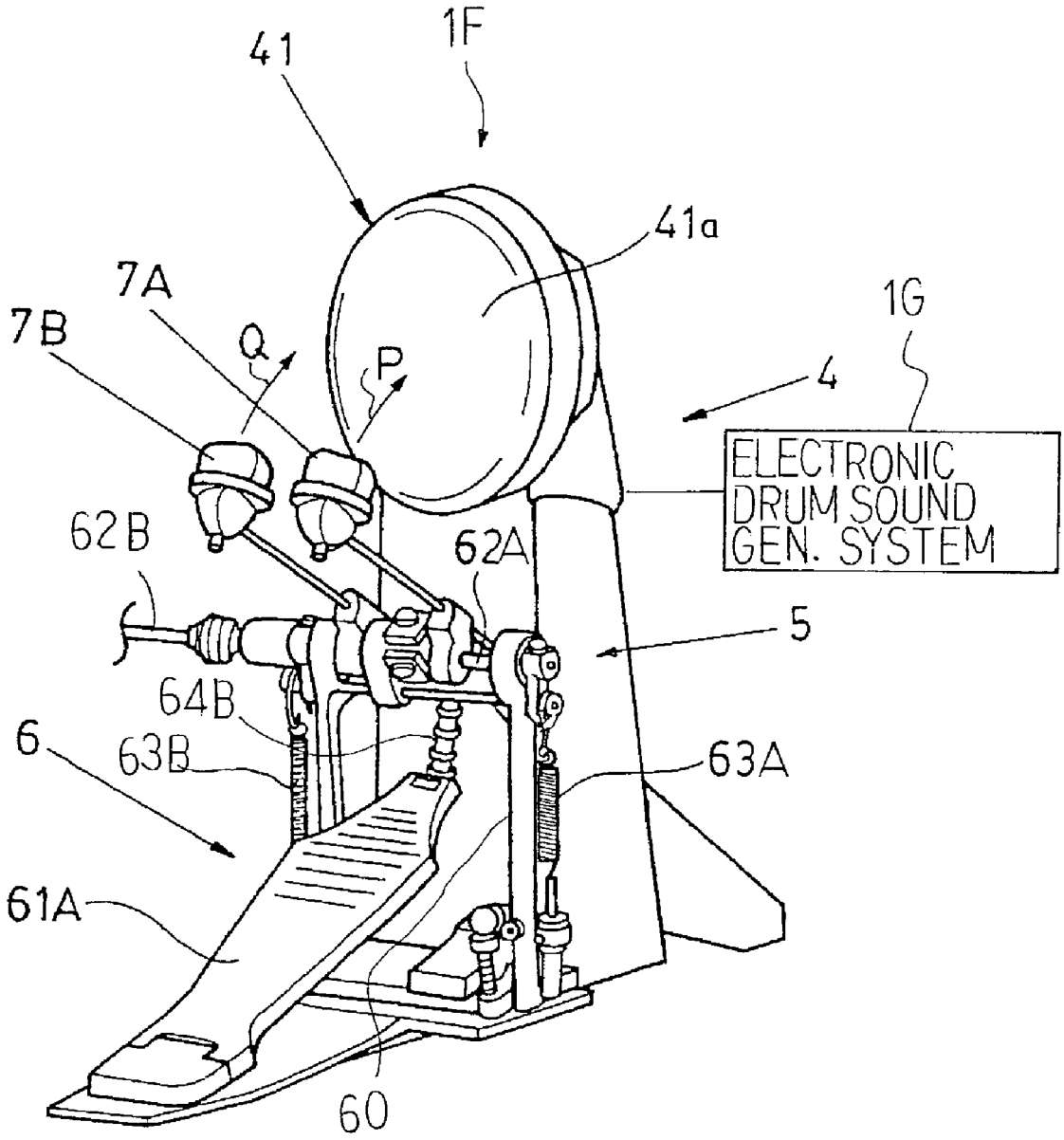
FIG. 18 is a perspective view showing yet another electronic drum system according to the present invention.
Figure 19:
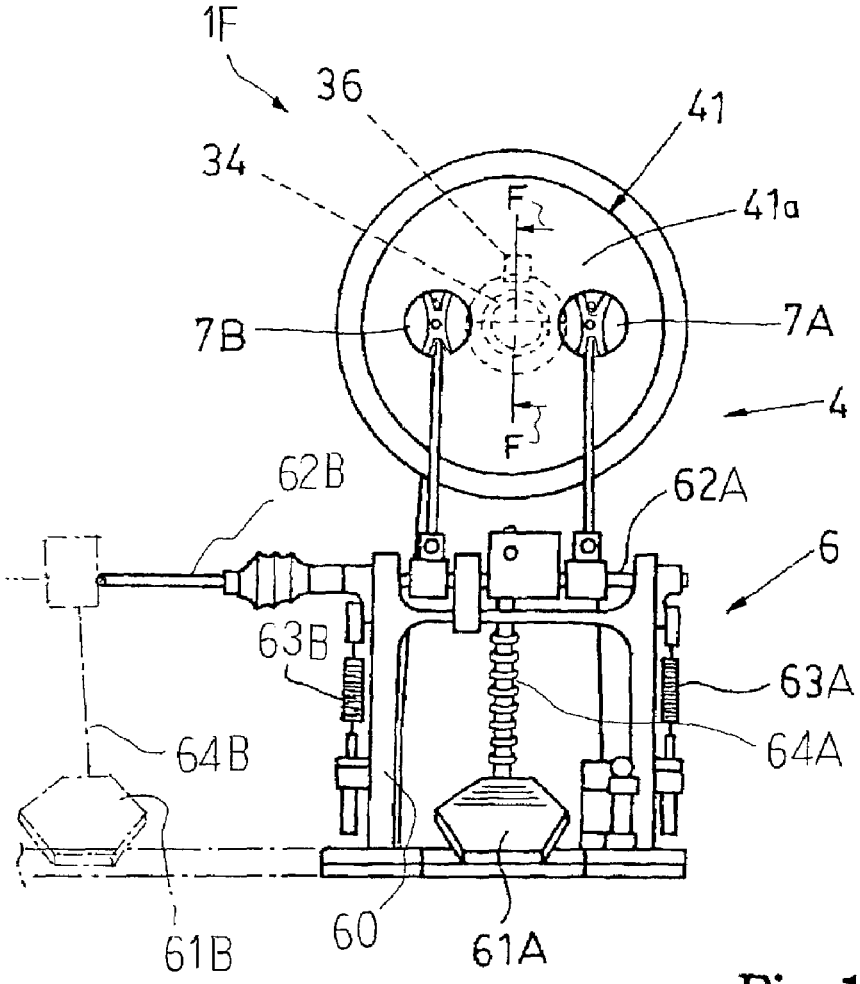
FIG. 19 is a front view showing the electronic drum system.
Figure 20:
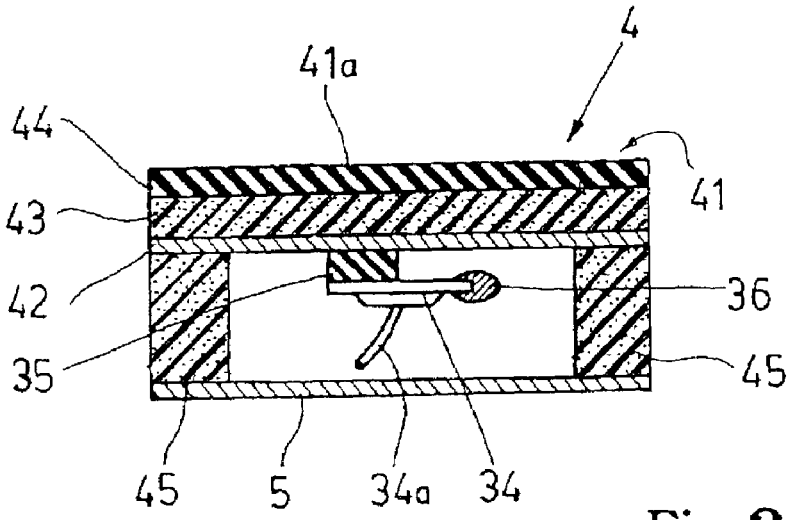
FIG. 20 is a cross sectional view take along line F—F and showing the structure of a kick pad incorporated in the electronic drum system.

FIGS. 18 to 20 show yet another electronic drum system 1F embodying the present invention. The electronic drum system 1F is corresponding to an acoustic bass drum. The electronic drum system 1F largely comprises an electronic kick pad 4, a frame 5, a foot pedal unit 6 and an electronic drum sound generating system 1G. The frame 5 is put on a floor, and the electronic kick pad 4 is supported by the frame 5. The foot pedal unit 6 is placed on the floor, and confronted with the electronic kick pad 4. When a drummer steps on the foot pedal unit 6, the electronic kick pad 4 is beaten, and vibrations are generated in the electronic kick pad 4. The electronic kick pad 4 converts the vibrations to an electric signal, and supplies it to the electronic drum sound generating system 1G. The electronic drum sound generating system analyzes the electric signal to see whether or not a beat is given onto the electronic kick pad 4. If the answer is negative, the electronic drum sound generating system 1G continues to analyze the electric signal for a beat. If, on the other hand, the answer is given affirmative, the electronic drum sound generating system 1G generates music data codes representative of the beats, and produces an audio signal representative of drum sound on the basis of the music data codes. The audio signal is converted to the drum sound.

The frame 5 is made of iron or steel, and has an external appearance like a pedestal. The electronic kick pad 4 is secured to the upper end portion of the frame 5.

The foot pedal unit 6 includes a frame 60, foot pedals 61A/61B, shafts 62A/62B, return springs 63A/63B, connectors 64A/64B and beaters 7A/7B. The shafts 62A/62B are supported by the frame 60, and are independently rotatable. The foot pedals 61A/61B are turnably connected at the lower ends thereof to the frame 60, and the upper ends of the foot pedals 61A/61B are connected to the connectors 64A/64B. The connectors interconnects the foot pedals 61A/61B to the associated shafts 62A/62B so that the drummer drives the shafts 62A/62B for rotation by stepping on the pedals 61A/61B. The return springs 63A/63B are connected between the frame 60 and the shafts 62A/62B, and urges the shafts 62A/62B in the counter clockwise direction in FIG. 18. The beaters 7A/7B are connected at the lower ends thereof to the associated shafts 62A/62B, and the upper ends of the beaters 7A/7B are rotatable along individual trajectories. The electronic kick pad 4 intersects the trajectories of the upper ends of the beaters 7A/7B.

The drummer is assumed to step on the foot pedal 61A, the foot pedal 61A pulls down the connector 64A, and gives rise to the rotation of the shaft 62A and, accordingly, the beater 7A against the elastic force of the return spring 63A in the clockwise direction indicated by arrow P. The beater 7A is moved along the trajectory, and strikes the electronic kick pad 4. When the drummer removes the force from the foot pedal 61A, the shaft 62A and beater 7A is rotated in the counter clockwise direction, and return to the rest position.

When the drummer steps on the other foot pedal 61B, the beater 7B strikes the electronic kick pad 4 as similar to the beater 7A. Upon removal from the foot pedal 61B, the return spring 63B causes the beater 7B to return to the rest position.

The electronic kick pad 4 includes a drum pad 41, a cushion 45, a filter element 35, a piezoelectric converter 35 and a weight 36. The cushion 45 is cylindrical, and is secured at one end thereof to the reverse surface of the drum pad 41 and at the other end thereof to the frame 5. As a result, an inner space is defined between the drum pad 41 and the frame 5, and the piezoelectric converter 34 is secured to the reverse surface of the drum pad 41 by means of the filter element 35 in a cantilever fashion. The weight 36 is secured to the free end of the piezoelectric converter 34, and causes the piezoelectric converter 34 to widely shaken.

The drum pad 41 has a rigid plate 42, a cushion layer 43 and a resilient layer 44. The rigid plate 42, cushion layer 43 and resilient layer 44 are disc shaped, and are laminated with one another. The rigid plate 42 is made of metal such as, for example, iron or steel, and is overlaid with the cushion layer 43. The cushion layer 43 is made of low impact resilience urethane sponge, and is overlaid with the resilient layer 44. The resilient layer 44 is made of rubber, and offers a major surface 41*a* to be beaten with beaters 7A/7B. When the major surface 41*a* is struck with the beater 7A/7B, the impact gives rise to vibrations in the rigid plate 42, and the vibrations are propagated through the filter element 35 to the piezoelectric converter 34.

The cushion 45 is also made of low impact resilience urethane sponge, and is thick enough to form the inner space where the filter element 35, piezoelectric converter 34 and weight 36 are accommodated without any collision of the weight 36 to the rigid plate 42 and frame 5.

The filter element 35 has a semi-circular shape, and is formed from a piece of adhesive double coated tape. This means that the filter element 35 is adhesive on both surfaces thereof. The piezoelectric converter 34 has a circular shape, and the diameter of the piezoelectric converter 34 is approximately equal to the diameter of the semi-circular filter element 35. The filter element 35 is adhered to the reverse surface of the rigid plate 42, and the piezoelectric converter 34 is coaxially adhered to the other surface of the filter element 35. This results in that the other half of the piezoelectric converter 34 is overhung from the filter element 35. In other words, the piezoelectric converter 34 is connected to the filter element 35 in a cantilever fashion.

The piezoelectric converter 34 converts stress to electric charge, and the electric charge flows out from the piezoelectric converter 34 into a signal cable 34*a*. The signal cable 34*a* is connected to the electronic drum sound generating system 1G.

The weight 36 is made of lead, and is fixed to the free end of the piezoelectric converter 34. The weight exerts an inertial force on the free end of the piezoelectric converter 34 in the vibrations, and increases the amplitude of the bending motion at the free end.

A drummer is assumed to step on the foot pedal 61A/61B. The associated beater 7A/7B is driven for rotation, and is brought into collision with the major surface 41*a*. The beaten spot is offset from the center of the drum pad 41. When the drummer steps on the other foot pedal 61B/61A, the impact is exerted on another beat spot also offset from the center of the drum pad 41. As will be better seen in FIG. 19, the beaten spots are outside of the area aligned with the piezoelectric converter 34.

The impact is exerted on the rigid plate 42 through the resilient layer 44 and cushion layer 43, and gives rise to vibrations of the rigid plate 42. The vibrations are propagated through the rigid plate 42 to the filter element 35, and are transmitted through the filter element 35 to the half of the piezoelectric converter 34 held in contact with the filter element 35. While the vibrations are being transmitted through the filter element 35, noise or high frequency vibration components are eliminated from the vibrations. The vibrations give rise to the stress in the half of the piezoelectric converter 34 held in contact with the filter element 35, and shake the other half of the piezoelectric converter 34. The weight 36 exerts the inertial force on the free end so that the piezoelectric converter 34 is widely bent. This results in that the bending stress is drastically increased in the piezoelectric converter 34. As a result, the electric signal widely swings the amplitude, and the electronic drum sound generating system 1G clearly discriminates the beats from noise.

The present inventor evaluated the electronic drum system 1F. The present inventor prepared a sample of the electronic drum system shown in FIGS. 18 to 20, and is hereinafter referred to as "first sample". The first sample had the overhung piezoelectric converter 34 with the weight 36. The present inventor further prepared another sample, which was similar to the first sample except for the weight 36, and is hereinafter referred to as "second sample". Although the second sample had the overhung piezoelectric converter 34, any weight 36 was not fixed to the free end of the overhung piezoelectric converter 34. The present inventor further prepared a sample, which had an overlapped piezoelectric converter, which was held in contact a circular filter element. The overlapped piezoelectric converter was not overhung from the circular filter element 35, and, accordingly, any weight was not fixed to the overlapped piezoelectric converter.

Figure 21:
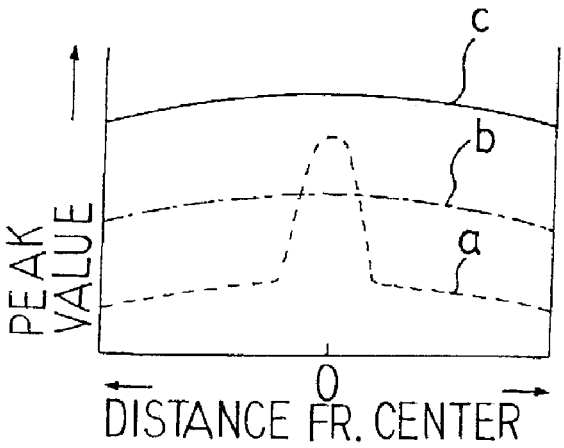
FIG. 21 is a graph showing peak values of the electric signal obtained in different samples at a constant impact.

The present inventor gave a constant impact on a virtual line passing through the center of the drum pad of each of the three samples, and plotted the potential level, viz., peak values of the electric signal at the expiry of the predetermined time period T1. The present inventor obtained plots c for the first sample, plots b for the second sample and plots for the third sample as shown in FIG. 21.

From plots a, it is understood that the vibrations merely give rise to the stress due to the directly generated bending moment. The peak values are small, and the local dependency is serious. It is understood from plots b that the excitation on the overhung piezoelectric converter 34 is effective against the local dependency. Comparing plots b with plots a, it is further understood that the overhung piezoelectric converter 34 makes the peak values larger than the peak values achieved by the overlapped piezoelectric converter.

Plots c teach us that the weight 36 makes the overhung piezoelectric converter 34 widely shaken, because the peak values on plots c are larger than the peak values on plots b. Moreover, the plots c are as flat as the plots b. This means that the overhung piezoelectric converter 34 with the weight 36 is still effective against the local dependency. In other words, the weight 36 does not have any undesirable influence on the overhung piezoelectric converter 34. Thus, the electronic drum system 1F eliminates the local dependency from the electric signal without using a large-sized piezoelectric converter.

Fourth Embodiment

Figure 22:
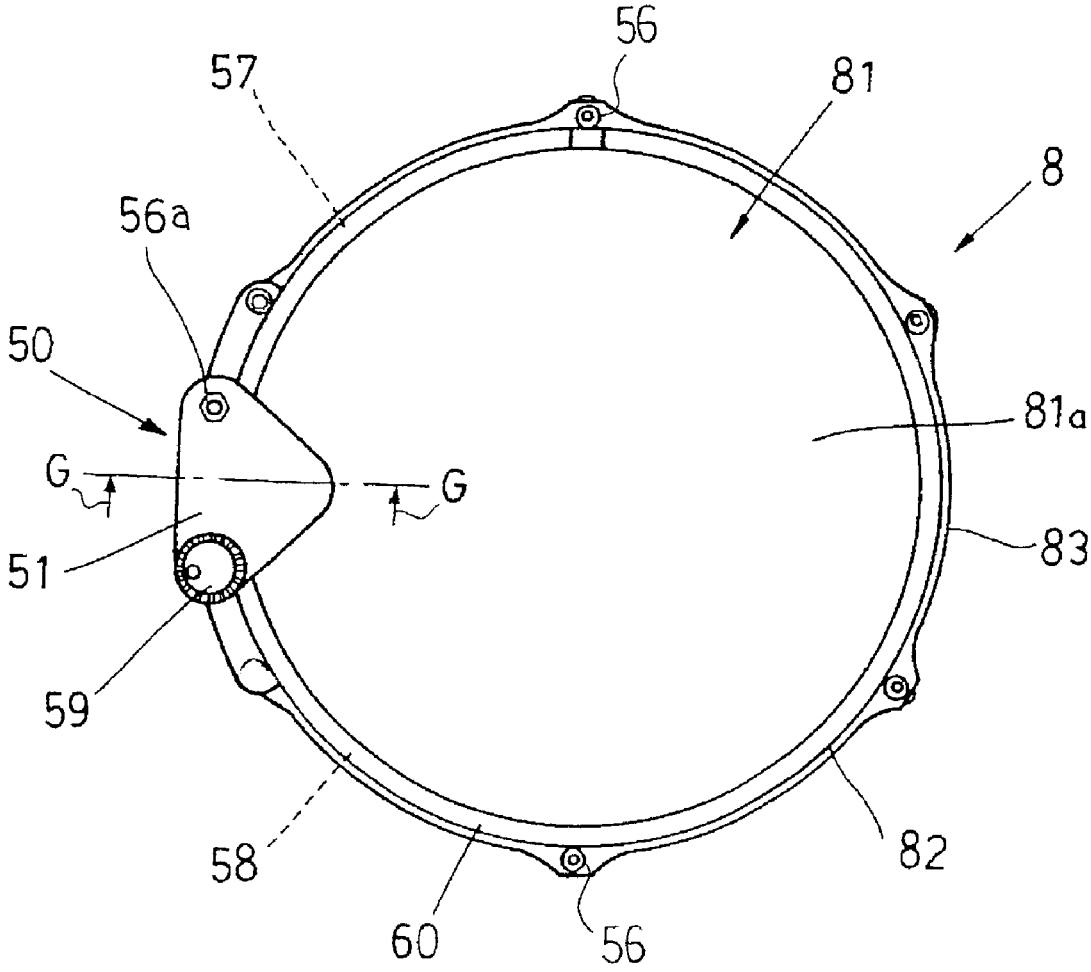
FIG. 22 is a plane view showing an electronic drum incorporated in still another electronic drum system according to the present invention.
Figure 23:
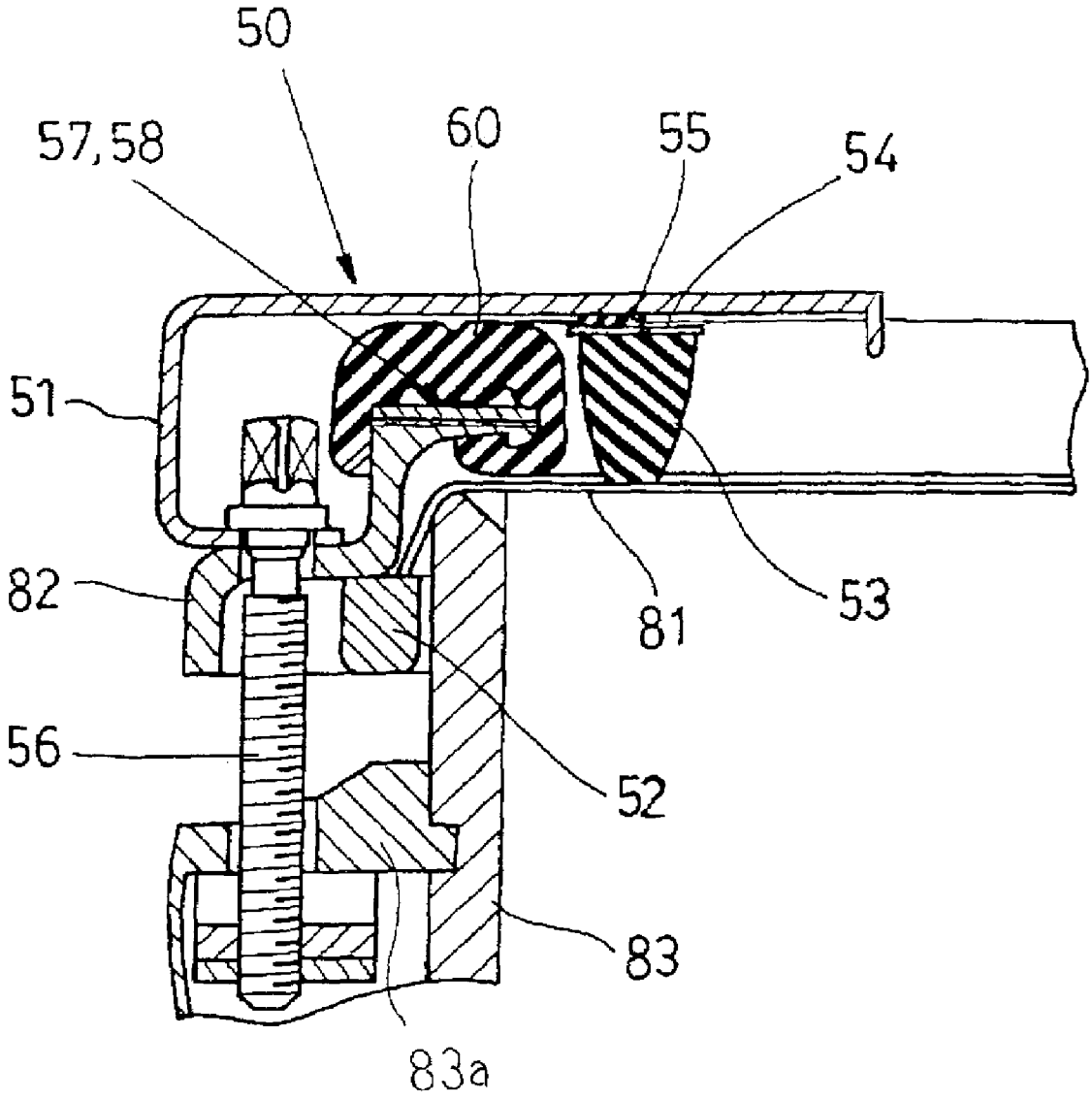
FIG. 23 is a cross sectional view taken along line G—G of FIG. 22 and showing the structure of the electronic drum.

FIGS. 22 and 23 show an electronic drum 8 incorporated in still another electronic drum system embodying the present invention. The electronic drum 8 may be used as an electronic snare drum. Although the electronic drum system further comprises a drum stand and an electronic sound generating system, the drum stand and electronic sound generating system are similar to the snare stand 1B and electronic sound generating system, and no further description is hereinafter incorporated for the sake of simplicity.

The electronic drum 8 comprises a hoop 52, tension bolts 56, a drum pad 81, a rim 82 and a shell 83. In this instance, the drum pad 81 is implemented by a skin or a mesh head used in acoustic drums. The shell 83 is cylindrical, and defines a cylindrical space. The drum pad 81 is larger in diameter than the shell 83, and is pinched with the hoop 52 along the periphery thereof. The drum pad 81 extends over one end of the shell 83, and the shell 83 is inserted into the hoop 52. Lugs 83*a* radially project from the shell 83 at intervals, and the rim 82 is pressed to the hoop 52. The tension bolts 56 are screwed into the lugs 83*a* so that the rim 82 exerts tensile force on drum pad 81 through the hoop 52. Thus, the drum pad 81 is stretched over the shell 83.

The electronic drum 8 further comprises a sensor unit 50, which includes a sensor holder 51, plural impact sensors and a rotary encoder 59. The sensor holder 51 is secured to the rim 82 by means of bolts 56*a*, and is overhung over the drum pad 81.

One of the impact sensors is provided in the space between the drum pad 81 and the sensor holder 51, and has filter elements 53/55 and a piezoelectric converter 54. The filter element 55 is made of butyl rubber, and is adhered to the reverse surface of the sensor holder 51. A part of the piezoelectric converter 54 is adhered to the filter element 55, and is supported by the sensor holder 51 in a cantilever fashion. In other words, although the piezoelectric converter 54 is partially adhered to the filter element 55, the remaining part is overhung under the reverse surface of the sensor holder 51. The filter element 55 prevents the piezoelectric converter from the noise. The other filter element 53 is adhered to the entire lower surface of the piezoelectric converter 54 so as to downwardly project from the piezoelectric converter 54. The filter element 53 is held in contact with the drum pad 81 at the lower end thereof The filter element 53 is made of rubber or urethane sponge.

The vibrations are propagated from the drum pad 81 through the filter element 53 to the piezoelectric converter 54 and from the sensor holder 51 through the filter element 55 to the piezoelectric converter 54. The piezoelectric converter 54 serves as the overhung piezoelectric converter for the vibrations propagated from the rim 82 through the sensor holder 51 and the filter element 55. However, the piezoelectric converter 54 serves as the overlapped piezoelectric converter for the vibrations propagated from the drum pad 81 through the filter element 53. This is because of the facts that the rim shots give rise to impacts to the rim cushion 60 and that the pad shots make the drum pad 81 waved. The impacts on the rim pad 60 are decayed before reaching the piezoelectric converter 54. For this reason, the piezoelectric converter 54 is overhung under the sensor holder 51 for increasing the magnitude of the vibrations. However, the waves still have wide amplitude at the piezoelectric converter 54. Even though the filter element 53 and the piezoelectric converter 54 are held in contact with the entire surfaces thereof, the waves give rise to large stress in the piezoelectric converter 54.

In case where the drum pad 81 is implemented by a rigid plate covered with a resilient layer, it is preferable that both of the filter elements 83/85 are adhered to the piezoelectric converter 84 in the cantilever-fashion.

The other impact sensors extend on the halves of the rim 82, respectively for detecting rim shots. These impact sensors have respective film switches 57/58, and the film switches 57/58 are covered with a ring-shaped rim cushion 60. The ring-shaped rim cushion 60 is made of resilient material such as, for example, rubber. The film switch 57 extends on the half of the rim 82 farther from a drummer than the other half covered with the film switch 58. In the electronic drum 8 shown in FIG. 22, the film switch 57 is disposed on the lower half of the rim 82, and the other film switch 58 extends on the upper half of the rim 82.

The film switches 57 and 58 are independent of one another, and are connected in parallel through the rotary encoder 59 to the electronic sound generating system. There are two sorts of rim shots. One of the sorts of rim shots is called as "closed rim shot", and a drummer gives an impact against the rim cushion 60. The other sort of the rim shots is called as "open rim shot", and the drummer gives the impact against both of the rim cushion 60 and drum pad 81. The film switches 57/58 selectively turn on depending upon the sort of rim shots so as to generate electric signals. The rotary encoder 59 has variable resistors, and the drummer changes the timbre of the drum sound by manipulating the rotary encoder 59. The electric signals are supplied to the electronic sound generating system, and analyze the electric signals to see whether the drummer gives the electronic drum 8 the open rim shot or the closed rim shot.

Assuming now that a drummer is beating the electronic drum 8, the drummer selectively gives impact on the rim cushion 60 and drum pad 81 for his or her performance. When the drummer hits the drum pad 81 with a stick, the impact gives rise to waves on the drum pad 81, and the waves reach the filter element 53. The filter element 53 eliminates high frequency vibration components from the waves, and the strong low frequency vibration components generate the stress in the piezoelectric converter 54. The film switches 57/58 are in the off-state, and the electronic sound generating system produces electronic drum sound for the pad shot.

If the drummer gives the rim shot to the rim cushion 60 or both of the rim cushion and drum pad 81, the rim shot gives rise to vibrations, and the vibrations are propagated through the rim cushion, rim 82 and sensor holder 51 to the filter element 55. The filter element 53 eliminates the high frequency vibration components from the input vibrations, and transfers the low frequency vibration components to the piezoelectric converter 54. The piezoelectric converter 54 is shaken, and a large stress is generated therein. Thus, the electric signal is supplied to the electronic sound generating system. The film switch 57/58 turns on, and supplies the electric signal through the rotary encoder 59 to the electronic sound generating system. The electronic sound generating system analyzes these electric signals, and determines the sort of rim shot, i.e., either open or close rim shot. The electronic sound generating system generates drum sound for the rim shot.

As will be understood from the foregoing description, the filter elements 53/55 eliminate the high frequency vibration components from the input vibrations. Even if the low frequency vibration components have been decayed, the overhung piezoelectric converter 54 is shaken so that the piezoelectric converter 54 generates the electric signal with the wide amplitude without serious local dependency. Thus, the electronic drum system according to the present invention produces the electronic drum sound through the small-sized piezoelectric converter. In case where impacts are given onto a skin or a mesh head, the overlapped piezoelectric converter is available for the detection of vibrations, and the impact sensor is of the compromise between the overlapped converter and the overhung converter.

Although particular embodiments of the present invention have been shown and described, it will be apparent to those skilled in the art that various changes and modifications may be made without departing from the spirit and scope of the present invention.

The filter element 15 may be a piece of adhesive double coated tape, which has a flexible sheet of sponge coated with adhesive compound layers on both surfaces thereof.

The overhung piezoelectric converter 24 may be directly adhered to the rim 12*a* by means of the semi-circular filter element 25.

The contact area between the piezoelectric converter and the filter element may be more than a half or less than the half of the surface of the piezoelectric converter.

The semi-circular filter elements and circular piezoelectric converters do not set any limit on the technical scope of the present invention. The filter element and piezoelectric converter may have shapes different from the semi-circle and circle in so far as the piezoelectric converter is supported by the filter in a cantilever fashion.

The filter element may simply support the piezoelectric converter without elimination of noise. In this instance, the piezoelectric converter is simply supported by a drum pad by means of a connector in a cantilever fashion, and the noise or high frequency components are eliminated through a data processing executed by the electronic sound generating system.

The weight 36 may be made of another sort of heavy metal or alloy. Lead is a mere example. A weight may be fixed to the free end of the piezoelectric converter 14/14*b*/54.

An electronic drum system corresponding to the bass drum may have two electronic kick pads respectively beaten with the beaters 7A/7B. Another electronic drum system corresponding to the bass drum may have only one beater for striking the electronic kick pad.

The piezoelectric converter may serve as the overhung converter to the vibrations propagated from both of the sensor holder 51 and the drum pad 81. In this instance, the filter element 53 is held in contact with a part of the piezoelectric converter 54 as similar to the other filter element 55.

The rubber, adhesive double coated tape, urethane sponge and butyl rubber do not set any limit on the scope of the present invention. Any material is available for the filter element in so far as the material eliminates undesirable noise components from the vibrations.

The piezoelectric converter does not set any limit on the scope of the present invention. Another sort of vibration-to-electric signal converter is available for the electronic percussion instrument. Other examples of the vibration-to-electric signal converter are a combination of an iron piece and a coil and a combination of a permanent magnetic piece and a coil.

The present invention is applicable to other sort of percussion instrument such as, for example, an electronic cymbal or cymbals, a marimba and a vibraphone.

The drum pads 16, 16*a*, 41 and 81 serve as a vibration propagating member or a first vibration propagating member. The filter elements 15, 15*a*, 35 and 53 serve as a connector or a first connector. The piezoelectric converter 14, 14*b*, 34 and 54 are corresponding to a vibrations-to-electric signal converter or a first vibrations-to-electric signal converter.

The rim 12*a* and shell 13*a* as a whole constitute a second vibration propagating member, and a filter element 25 serves as a second connector. The piezoelectric converter 24 is corresponding to a second vibrations-to-electric signal converter.

What is claimed is:

1. An electronic percussion instrument for generating an electric signal representative of vibrations, comprising:

a vibration propagating member to be struck for generating vibrations;

a semi-circular filter element having a first surface connected to said vibration propagating member and a second surface and formed of material for eliminating noise components from said vibrations; and a vibrations-to-electric signal converter having a surface partially connected to said second surface and partially projecting from said connector so as to be spaced from said vibration propagating member, and shaken in the presence of said vibrations for enlarging the magnitude of an electric signal output therefrom.

2. The electronic percussion instrument as set forth in claim 1, in which said noise components are high frequency vibrations so that said connector transmits low frequency vibrations from said first surface to said second surface.

3. The electronic percussion instrument as set forth in claim 1, in which said vibration propagating member is supported by a rim.

4. The electronic percussion instrument as set forth in claim 3, in which said rim is fixed to a cylindrical shell.

5. The electronic percussion instrument as set forth in claim 1, in which said vibrations-to-electric signal converter is made of piezoelectric material so that said vibrations on said second surface generates a first sort of stress directly in said vibrations-to-electric signal converter and a second sort of stress in said vibrations-to-electric signal converter through bending moment due to the shakes, thereby enlarging said magnitude of said electric signal.

6. The electronic percussion instrument as set forth in claim 5, in which said connector transmits low frequency vibration components to said piezoelectric material after elimination of high frequency noise components from said vibrations.

7. The electronic percussion instrument as set forth in claim 6, in which said connector receives said vibrations from a rigid plate forming a part of said vibration propagating member together with a resilient member onto which an impact is given.

8. The electronic percussion instrument as set forth in claim 1, further comprising at least one beater linked with a foot pedal and driven for rotation to strike said vibration propagating member by a player when said player steps on said foot pedal.

9. The electronic percussion instrument as set forth in claim 1, further comprising, a weight secured to a free end of said vibrations-to-electric signal converter, wherein the weight increases the amplitude of the electric signal.

10. An electronic percussion instrument for generating a first electric signal representative of first vibrations and a second electric signal representative of second vibrations, comprising:

a first vibration propagating member to be struck for generating said first vibrations;

a second vibration propagating member to be struck for generating said second vibrations;

a first connector having a first surface receiving said first vibrations from said first vibration propagating member and a second surface onto which said first vibrations are transmitted from said first surface, said first connector being formed of material eliminating noise components from said first vibrations;

a first vibrations-to-electric signal converter connected to said second surface of said first connector in a cantilever fashion, and shaken in the presence of said first vibrations for enlarging a magnitude of said first electric signal; and a second connector having a third surface receiving said second vibrations from said second vibration propagating member and a fourth surface onto which said second vibrations are transmitted, said second connector being formed of material eliminating noise components from said second vibrations; and a second vibrations-to-electric signal converter connected to said fourth surface in a cantilever fashion, and shaken in the presence of said second vibrations for enlarging a magnitude of said second electric signal, wherein a single piece of piezoelectric material serves as both of said first and second vibrations-to-electric signal converters, in which said single piece of piezoelectric material is overhung from said second connector in a cantilever fashion and held in contact with said first connector without any overhang in such a manner that said first connector downwardly projects from said single piece of piezoelectric material.

11. The electronic percussion instrument as set forth in claim 10, in which said second vibration propagating member defines a hollow space, and said first vibration propagating member occupies in said hollow space.

12. The electronic percussion instrument as set forth in claim 11, in which said first vibration propagating member is a drum pad, and said second vibration propagating member is a combination of a cylindrical shell and a rim through which said drum pad is secured to said shell.

13. The electronic percussion instrument as set forth in claim 12, in which said second connector is secured to said shell.

14. The electronic percussion instrument as set forth in claim 12, in which said first connector and said second connector are secured to said drum pad and one of said shell and said rim, and eliminate noise components from said first vibrations and said second vibrations, respectively.

15. The electronic percussion instrument as set forth in claim 10, in which said first vibrations-to-electric signal converter and said second vibrations-to-electric signal converters are a first piece of piezoelectric material and a second pieces of piezoelectric material so that so that said first vibrations and said second vibrations generate a first sort of stress directly in said first vibrations-to-electric signal converter and said second vibrations-to-electric signal converter, respectively, and a second sort of stress in said first vibrations-to-electric signal converter and said second vibrations-to-electric to-electric signal converter through bending moment due to the shakes, thereby enlarging said magnitude of said first electric signal and said magnitude of said second electric signal.

16. The electronic percussion instrument as set forth in claim 10, in which said second vibration propagating member is cylindrical forming a space where said first vibration propagating member occupies, and said first connector is held contact with said first vibration propagating member at the lower end thereof.

17. An electronic percussion system for generating electronic percussion sound, comprising:

an electronic percussion instrument generating an electric signal representative of vibrations, and including a vibration propagating member to be struck for generating vibrations, a semi-circular filter element having a first surface receiving said vibrations from said vibration propagating member and a second surface onto which said vibrations are transmitted from said first surface, said connector being formed of material for eliminating noise components from said vibrations, and a vibrations-to-electric signal converter connected to said second surface in a cantilever fashion and shaken in the presence of said vibrations for enlarging a magnitude of said electric signal; and an electronic sound generating system connected to said vibrations-to-electric signal converter, analyzing said electric signal to see whether or not said vibration propagating member is struck, generating music data codes representative of beats on said vibration propagating member, producing an audio signal representative of said electronic percussion sound on the basis of said music data codes, and converting said audio signal to said electronic drum sound.

18. The electronic percussion system as set forth in claim 17, in which said vibrations-to-electric signal converter is made of piezoelectric material so that said vibrations on said second surface generates a first sort of stress directly in said vibrations-to-electric signal converter and a second sort of stress in said vibrations-to-electric signal converter through bending moment due to the shakes, thereby enlarging said magnitude of said electric signal.

19. The electronic percussion system as set forth in claim 17, in which said connector receives said vibrations from a rigid plate forming a part of said vibration propagating member together with a resilient member onto which an impact is given.

20. The electronic percussion system as set forth in claim 17, further comprising at least one beater linked with a foot pedal and driven for rotation to strike said vibration propagating member by a player when said player steps on said foot pedal.

21. The electronic percussion system as set forth in claim 17, further comprising a weight secured to a free end of said vibrations-to-electric signal converter, wherein the weight increases the amplitude of the electric signal.

22. The electronic percussion system as set forth in claim 17, further comprising of:

another connector secured to another vibration propagating member having a hollow space where said vibration propagating member occupies and:

another vibrations-to-electric signal converter connected to said another connector in a cantilever fashion so as to enlarge a magnitude of another electric signal supplied to said electronic sound generating system so that said electronic drum sound is generated in a different timbre when said another vibration propagating member is beaten.

23. The electronic percussion system as set forth in claim 22, in which said vibrations-to-electric signal converter and said another vibrations-to-signal converter are implemented by a piece of piezoelectric material, and said piece of piezoelectric material is held in contact with said connector without any overhang.

* * * * *